US007503730B2

(12) United States Patent
Price

(10) Patent No.: US 7,503,730 B2
(45) Date of Patent: Mar. 17, 2009

(54) MODULAR BLOCK WALL SYSTEM

(75) Inventor: Brian A. Price, Rochester, MN (US)

(73) Assignee: Mortarless Technologies, LLC, Rochester, MN (US)

( * ) Notice: Subject to any disclaimer, the term of this patent is extended or adjusted under 35 U.S.C. 154(b) by 112 days.

(21) Appl. No.: 11/700,576

(22) Filed: Jan. 31, 2007

(65) Prior Publication Data

US 2007/0234665 A1 Oct. 11, 2007

Related U.S. Application Data

(63) Continuation-in-part of application No. 29/260,132, filed on May 19, 2006, now Pat. No. Des. 540,477, and a continuation-in-part of application No. 29/260,133, filed on May 19, 2006, now Pat. No. Des. 540,478, and a continuation-in-part of application No. 29/260,134, filed on May 19, 2006, now Pat. No. Des. 551,359, and a continuation-in-part of application No. 29/260,135, filed on May 19, 2006, now Pat. No. Des. 538,947, and a continuation-in-part of application No. 29/260,136, filed on May 19, 2006, now Pat. No. Des. 539,439, and a continuation-in-part of application No. 29/260,137, filed on May 19, 2006, now Pat. No. Des. 551,360, and a continuation-in-part of application No. 29/260,138, filed on May 19, 2006, and a continuation-in-part of application No. 29/260,145, filed on May 19, 2006, now Pat. No. Des. 551,361.

(60) Provisional application No. 60/764,219, filed on Feb. 1, 2006.

(51) Int. Cl.
*E02D 29/02* (2006.01)

(52) U.S. Cl. ..... 405/286; 405/284

(58) Field of Classification Search ..... 405/286, 405/284, 262

See application file for complete search history.

(56) References Cited

U.S. PATENT DOCUMENTS 1,260,024 A 3/1918 Parton (Continued)

OTHER PUBLICATIONS

"Classic" product literature, Rockwood Retaining Walls, 12 pgs., 1997.

*Primary Examiner*—Frederick L Lagman
(74) *Attorney, Agent, or Firm*—Patterson, Thuente, Skaar & Christensen, P.A.

(57) ABSTRACT

A modular block wall system is comprised of a plurality of differently sized blocks. Each block comprises a front surface and opposing rear surface, a top surface and opposing bottom surface, and first and second opposing tapered side surfaces. Blocks further includes a recess extending inwardly from top surface and a protrusion extending outwardly from bottom surface. Blocks may also include a plurality of cores through the block from top surface to bottom surface. Blocks may further include a removable portion that can be cleaved off to create a decorative face on rear surface. The projection on each block is configured to fit within the recess of a block in the next lower course of blocks, regardless of the sizes of the respective blocks. Preferably, the varying lengths and heights of the blocks are evenly divisible by a uniform dimension. This allows modular blocks to be easily put together in any configuration to create a finished looking, yet non-uniform wall.

19 Claims, 45 Drawing Sheets

U.S. PATENT DOCUMENTS

| | | | | | |
|---|---|---|---|---|---|
| 1,795,451 | A | | 3/1931 | Sharpe | |
| 1,816,916 | A | | 8/1931 | Sentrop | |
| 2,019,653 | A | * | 11/1935 | Buyer | 52/592.5 |
| 4,909,010 | A | * | 3/1990 | Gravier | 405/286 |
| 5,484,236 | A | * | 1/1996 | Gravier | 405/286 |
| 5,622,456 | A | | 4/1997 | Risi et al. | |
| 5,647,185 | A | | 7/1997 | Fortilini | |
| 5,688,079 | A | * | 11/1997 | Bolduc et al. | 405/286 |
| 5,802,797 | A | * | 9/1998 | Storer-Folt | 52/592.5 |
| D403,437 | S | | 12/1998 | Risi et al. | |
| D405,193 | S | | 2/1999 | Scales | |
| 5,960,604 | A | * | 10/1999 | Blanton | 52/592.5 |
| 6,082,933 | A | * | 7/2000 | Maguire et al. | 405/286 |
| 6,178,715 | B1 | * | 1/2001 | Pacitto et al. | 405/286 |
| 6,457,911 | B1 | * | 10/2002 | Scales et al. | 405/286 |
| D466,229 | S | | 11/2002 | Risi et al. | |
| 6,474,036 | B2 | * | 11/2002 | Martin et al. | 52/592.6 |
| 6,523,317 | B1 | * | 2/2003 | Bott et al. | 405/286 |
| D479,342 | S | | 9/2003 | Dawson | |
| 6,651,401 | B2 | | 11/2003 | Price et al. | |
| D485,371 | S | | 1/2004 | Burgess et al. | |
| 6,679,656 | B1 | * | 1/2004 | Manthei | 405/286 |
| 6,715,965 | B2 | * | 4/2004 | Manthei et al. | 405/284 |
| 7,059,808 | B2 | | 6/2006 | Risi | |
| 7,096,635 | B2 | | 8/2006 | Price | |
| D538,947 | S | | 3/2007 | Price | |
| D539,439 | S | | 3/2007 | Price | |
| D540,477 | S | | 4/2007 | Price | |
| D540,478 | S | | 4/2007 | Price | |
| 7,328,537 | B2 | | 2/2008 | Hammer | |
| 2006/0179777 | A1 | | 8/2006 | Tufts et al. | |

* cited by examiner

SIDE VIEW

TOP VIEW

BOTTOM VIEW

SIDE VIEW

TOP VIEW

BOTTOM VIEW

SIDE VIEW

TOP VIEW

BOTTOM VIEW

SIDE VIEW

TOP VIEW

BOTTOM VIEW 511
516
508
500
511
512
520
522
504
506
511
509
522
518
502
510
511
514

500

516
504
506
512
510
502

600
612
620
616
608
618
604
606
610
602
614

600
616
604
606
612
610
602

800
812
820
816
808
818
804
810
806
802
814

800
812
816
804
806
810
802

800
804
816
808
812
810
802

1200
1208
1204
1210
1216
1212
1206

1206
1202
1210
1214
1200
1212
1208

1204
1200
1216
1208
1206
1210
1214
1202

MODULAR BLOCK WALL SYSTEM

RELATED APPLICATIONS

This application claims priority from U.S. Provisional App. No. 60/764,219, filed Feb. 1, 2006. This application is also a continuation-in-part of U.S. Des. App. No. 29/260,132 filed, May 19, 2006, now U.S. Pat. No. D, 540,477 U.S. Des. App. No. 29/260,133 filed, May 19, 2006, now U.S. Pat. No. D ,540,478 U.S. Des. App. No. 29/260,134 filed, May 19, 2006, now U.S. Pat. No. D, 551,359 U.S. Des. App. No. 29/260,135 filed, May 19, 2006 now U.S. Pat. No. D, 538, 947, U.S. Des. App. No. 29/260,136 filed, May 19, 2006, now U.S. Pat. No. D, 539,439 U.S. Des. App. No. 29/260,137, filed, May 19, 2006 now U.S. Pat. No. D, 551,360, U.S. Des. App. No. 29/260,138, filed May 19, 2006, and U.S. Des. App. No. 29/260,145, filed, May 19, 2006 now U.S. Pat No. D, 551,361. The entire disclosures of the prior applications are considered part of the disclosure of the accompanying application and are hereby incorporated by reference therein.

FIELD OF THE INVENTION

The present invention relates generally to stackable blocks to form walls and more particularly to interlocking stackable blocks that can create both retaining walls and free-standing walls of non-uniform appearance.

BACKGROUND OF THE INVENTION

Block wall systems are often used for retaining earth, decoration, privacy, or as support for fence panels, gates, or other such structures. Such systems are desirable because they provide an aesthetically pleasing appearance, resist weathering, and require little maintenance. Concrete block wall construction utilizes molded blocks of concrete that may be stacked in courses without the use of mortar. These blocks can be assembled quickly and economically due to the interlocking of adjacent courses of blocks. Typically, each block includes some type of interlocking system such as pins, lips or projections so that one course of blocks interlock with an adjacent course of blocks to create a stable structure. Blocks having these interconnections are generally of uniform size and shape, so that a wall created with such blocks must have a uniform appearance.

A recent development in block wall construction has been the advent of non-uniform, blended pattern walls. Non-uniform walls can be constructed from blocks of different sizes that are given complementary interlocking features. Examples of such blocks are U.S. patent application Pat. No. 7,096,635 and U.S. Pat. No. 6,651,401, which are hereby incorporated by reference in their entirety.

SUMMARY OF THE INVENTION

A modular block wall system includes of a plurality of differently sized blocks. Each block includes a front surface and opposing rear surface, a top surface and opposing bottom surface, and first and second opposing tapered side surfaces. Blocks further include a recess extending inwardly from top surface and a protrusion extending outwardly from bottom surface. Blocks may also include a plurality of cores through the block from top surface to bottom surface. Blocks may further include a removable portion that can be cleaved off to create a decorative face on rear surface. The projection on each block is configured to fit within the recess of a block in the next lower course of blocks, regardless of the sizes of the respective blocks. Preferably, the varying lengths and heights of the blocks are evenly divisible by a uniform dimension. This allows modular blocks to be easily put together in any configuration to create a finished looking, yet non-uniform wall.

BRIEF DESCRIPTION OF THE DRAWINGS

The invention may be more completely understood in consideration of the following detailed description of various embodiments of the invention in connection with the accompanying drawings, in which.

DETAILED DESCRIPTION

Figure 1:
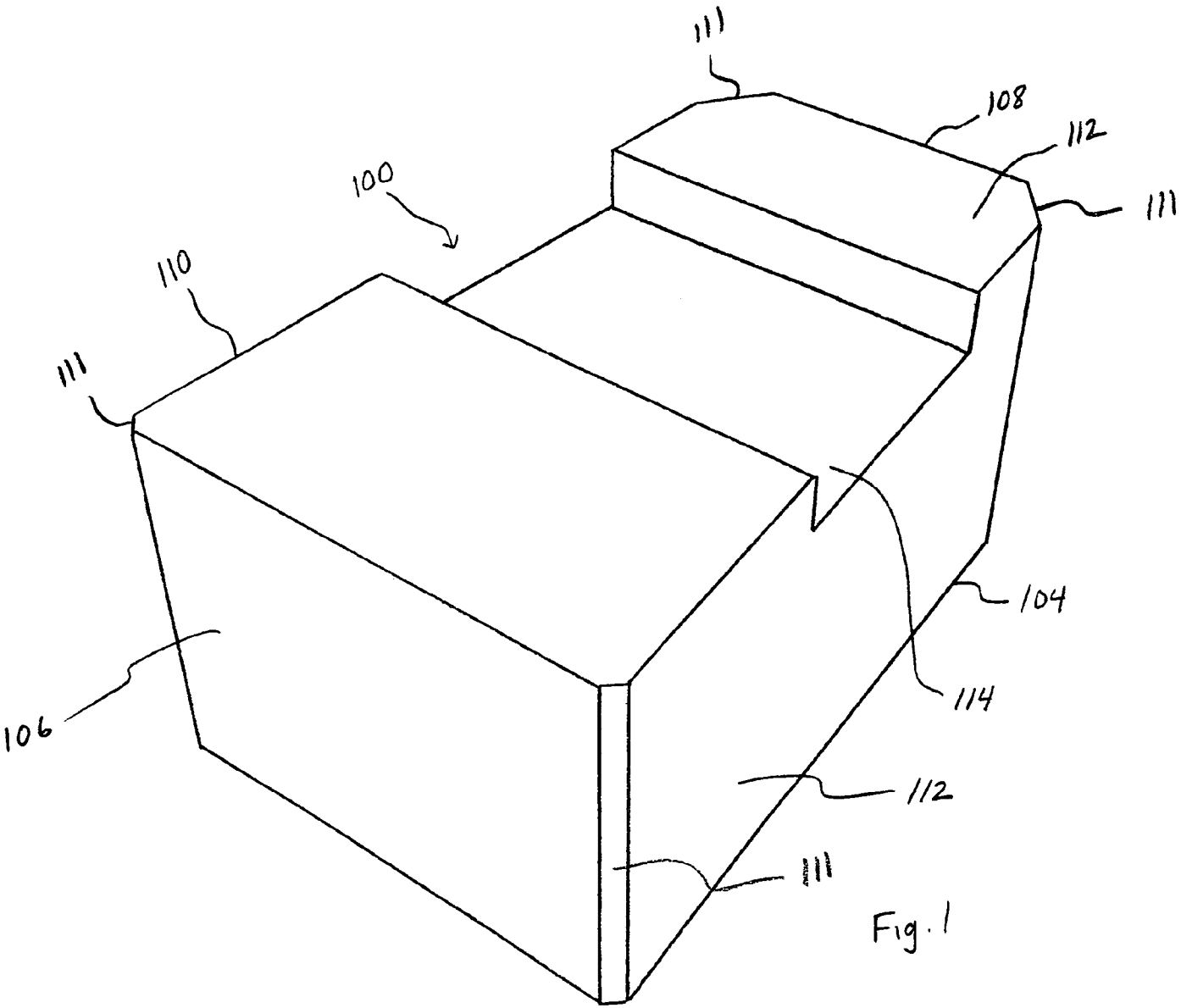
FIG. 1 is a perspective view of a modular block according to an embodiment of the present invention.
Figure 2:
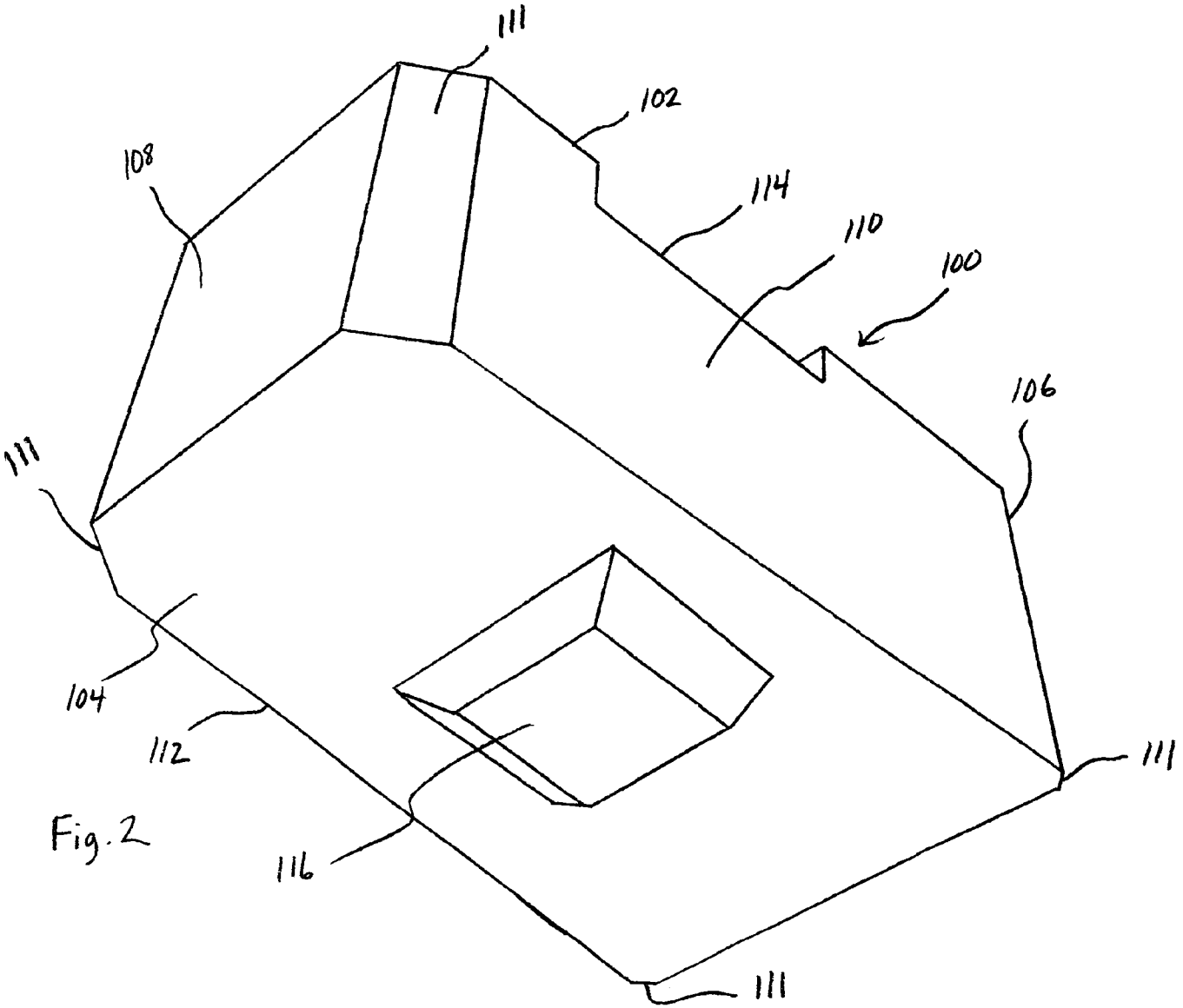
FIG. 2 is a perspective view of the modular block of FIG. 1 according to an embodiment of the present invention.
Figure 3C:
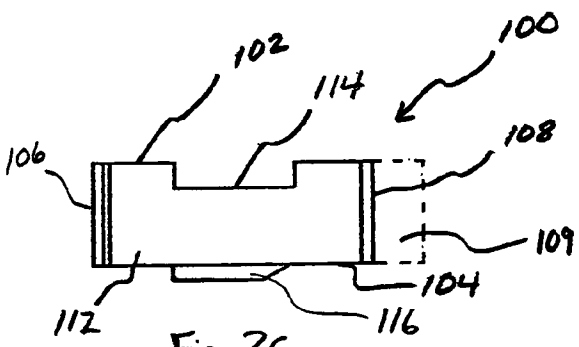
FIG. 3C is a side view of a modular block according to an embodiment of the present invention.
Figure 3B:
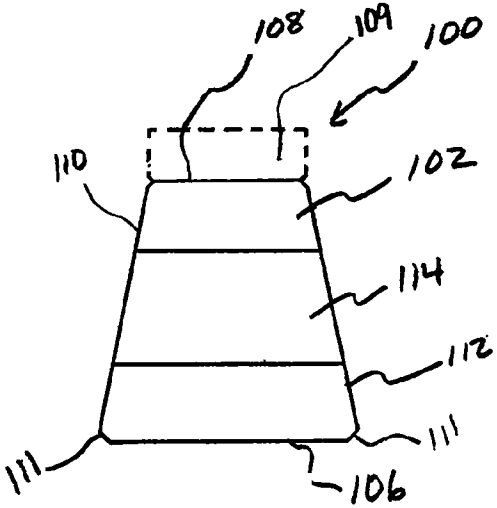
FIG. 3B is a top view.
Figure 3A:
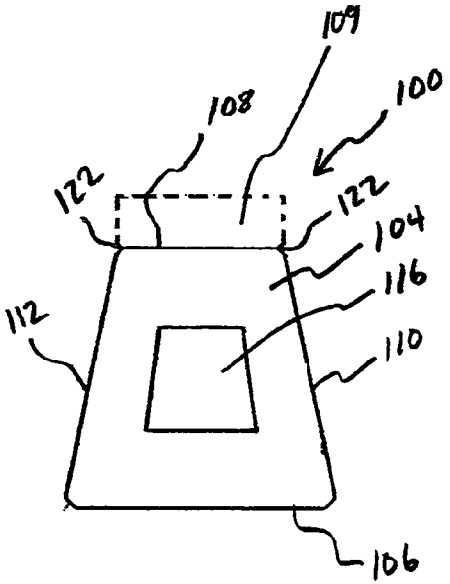
FIG. 3A is a bottom view.
Figure 4:
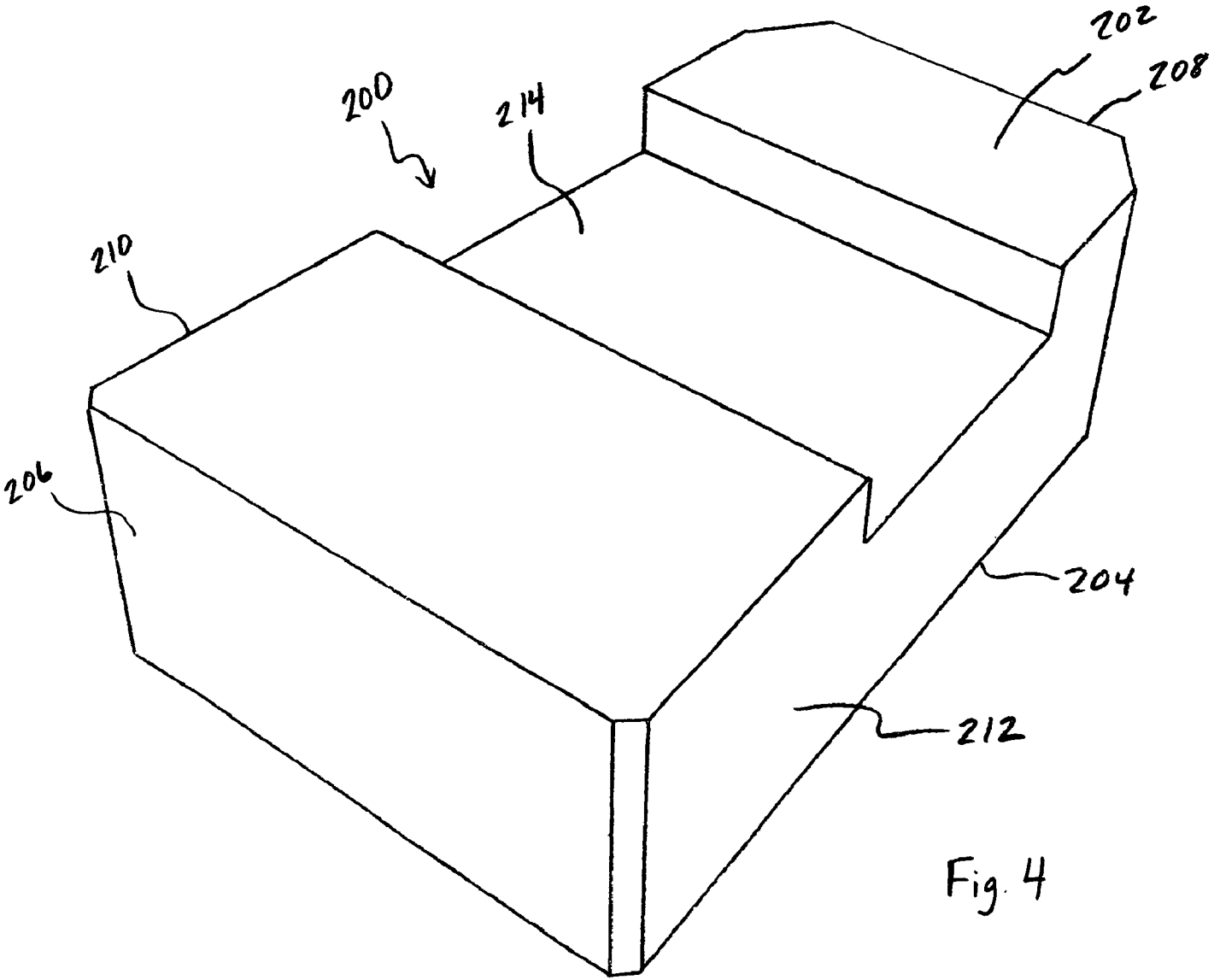
FIG. 4 is a perspective view of a modular block according to an embodiment of the present invention.
Figure 5:
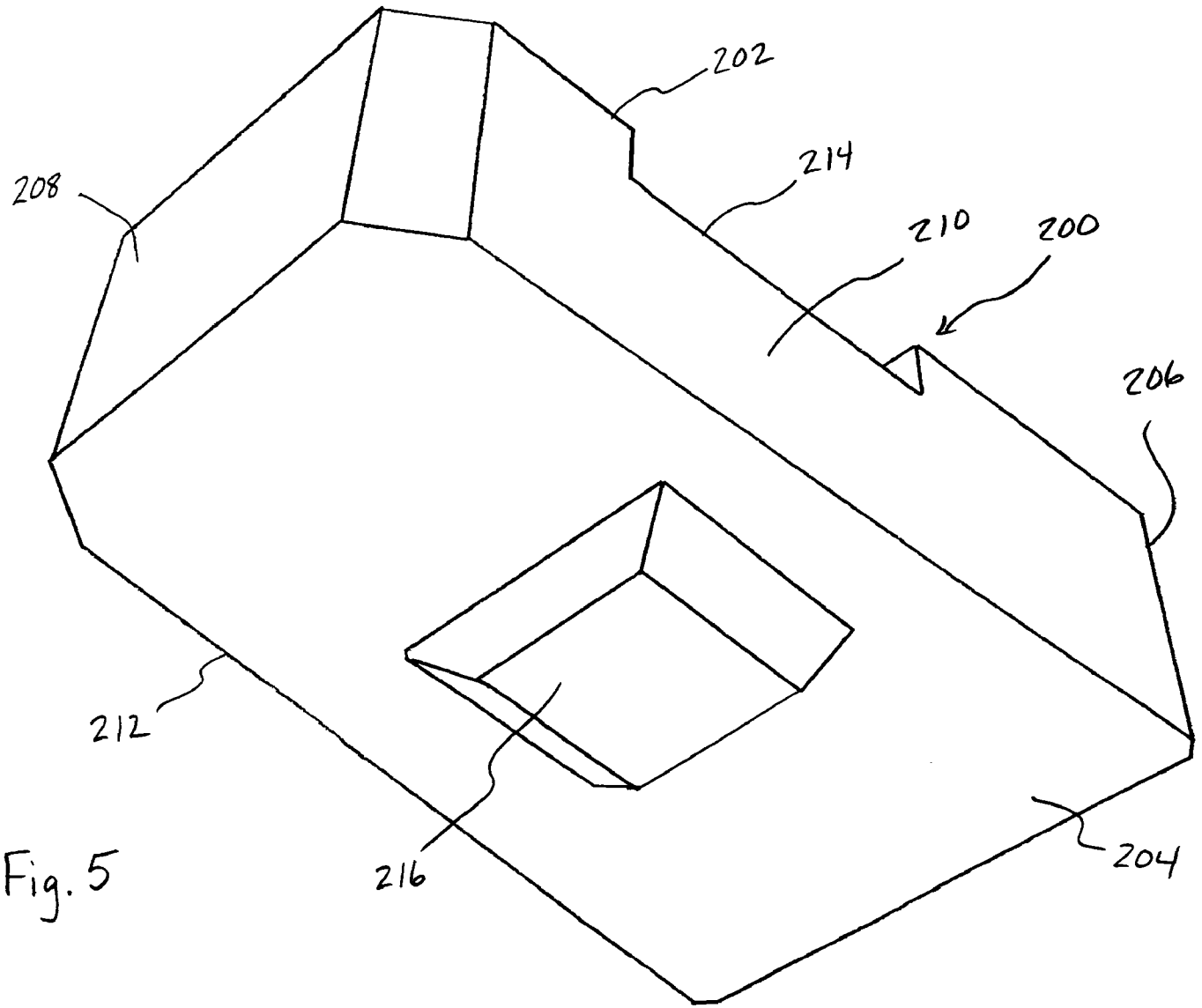
FIG. 5 is a perspective view of the modular block of FIG. 4 according to an embodiment of the present invention.
Figure 6C:
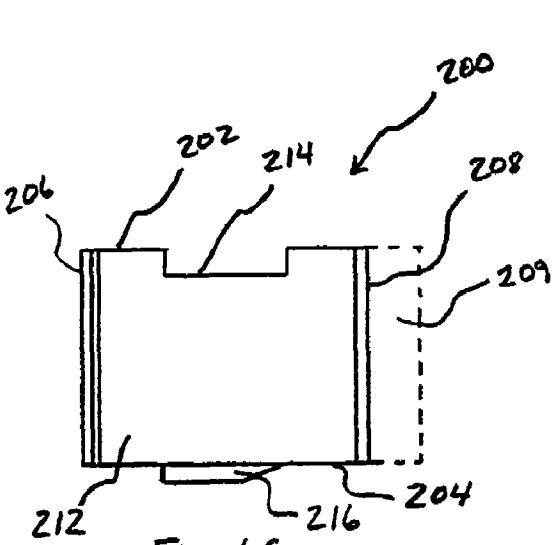
FIG. 6C is a side view of a modular block according to an embodiment of the present invention.
Figure 6B:
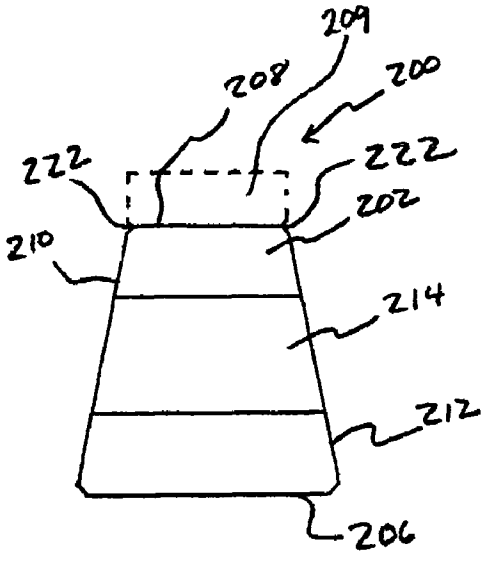
FIG. 6B is a top view.
Figure 6A:
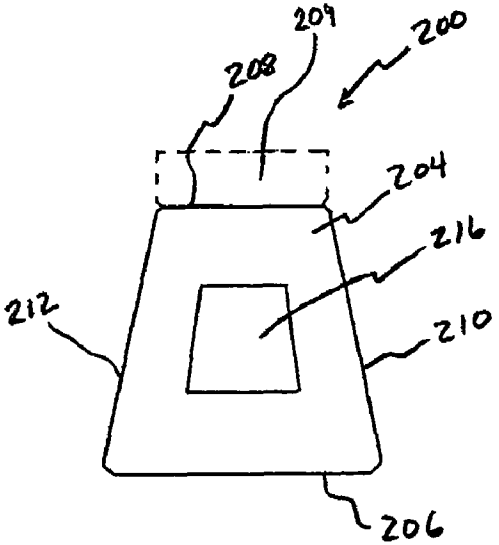
FIG. 6A is a bottom view.
Figure 7:
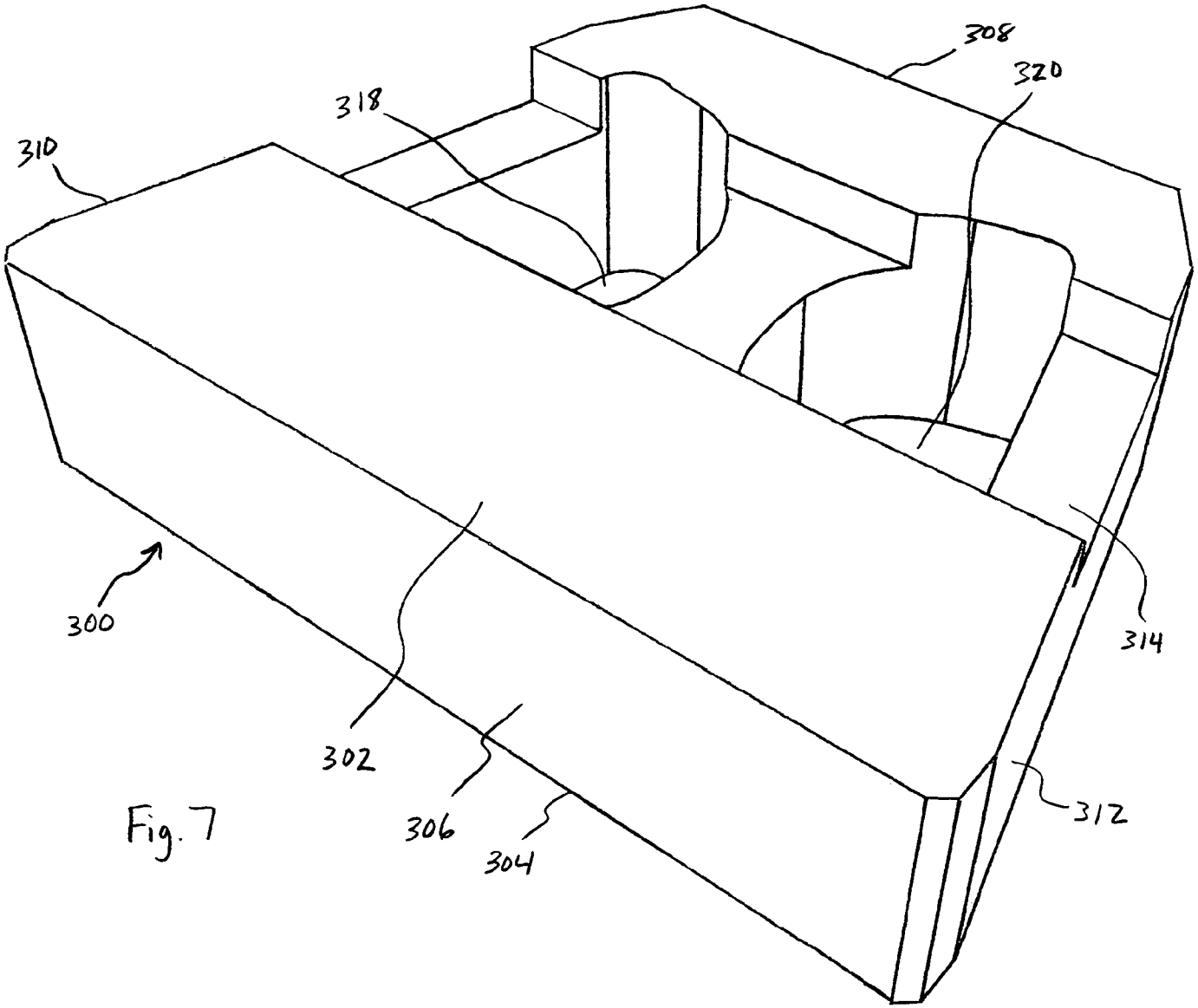
FIG. 7 is a perspective view of a modular block according to an embodiment of the present invention.
Figure 8:
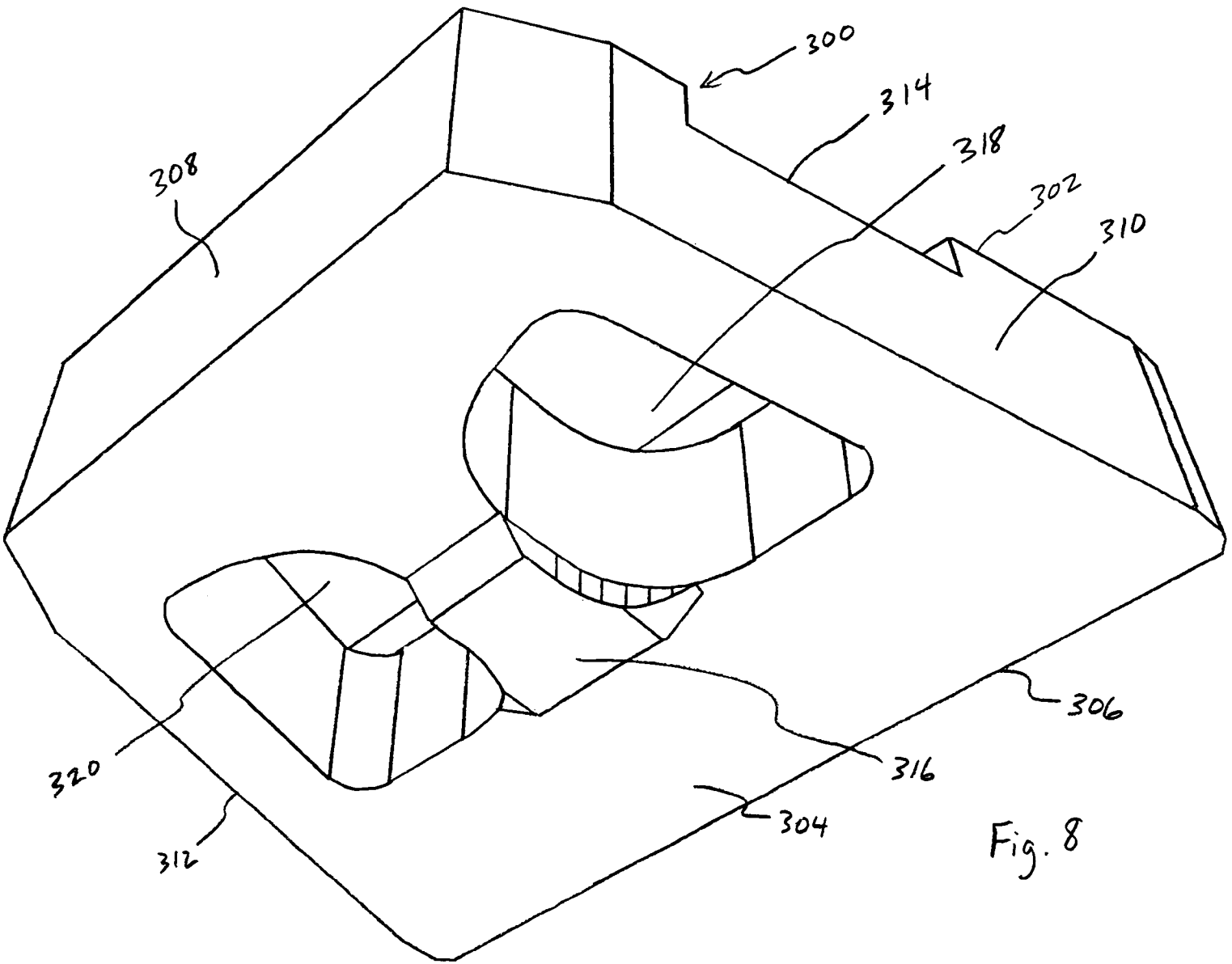
FIG. 8 is a perspective view of the modular block of FIG. 7 according to an embodiment of the present invention.
Figure 9C:
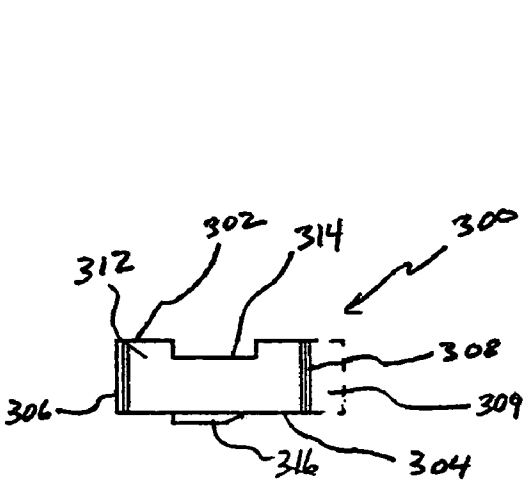
FIG. 9C is a side view of a modular block according to an embodiment of the present invention.
Figure 9B:
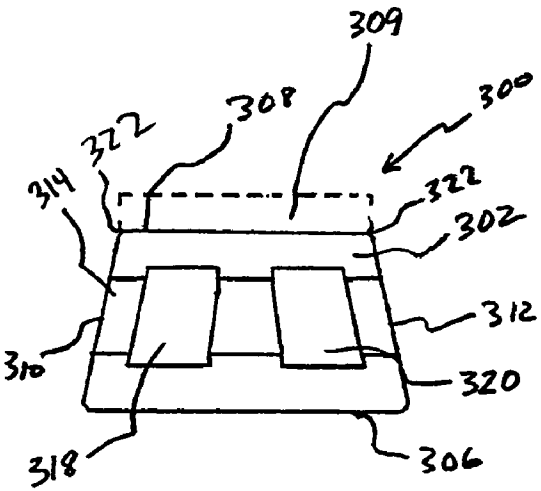
FIG. 9B is a top view.
Figure 9A:
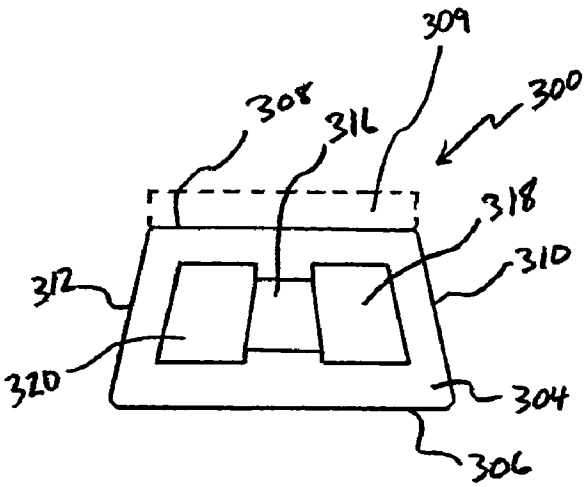
FIG. 9A is a bottom view.
Figure 10:
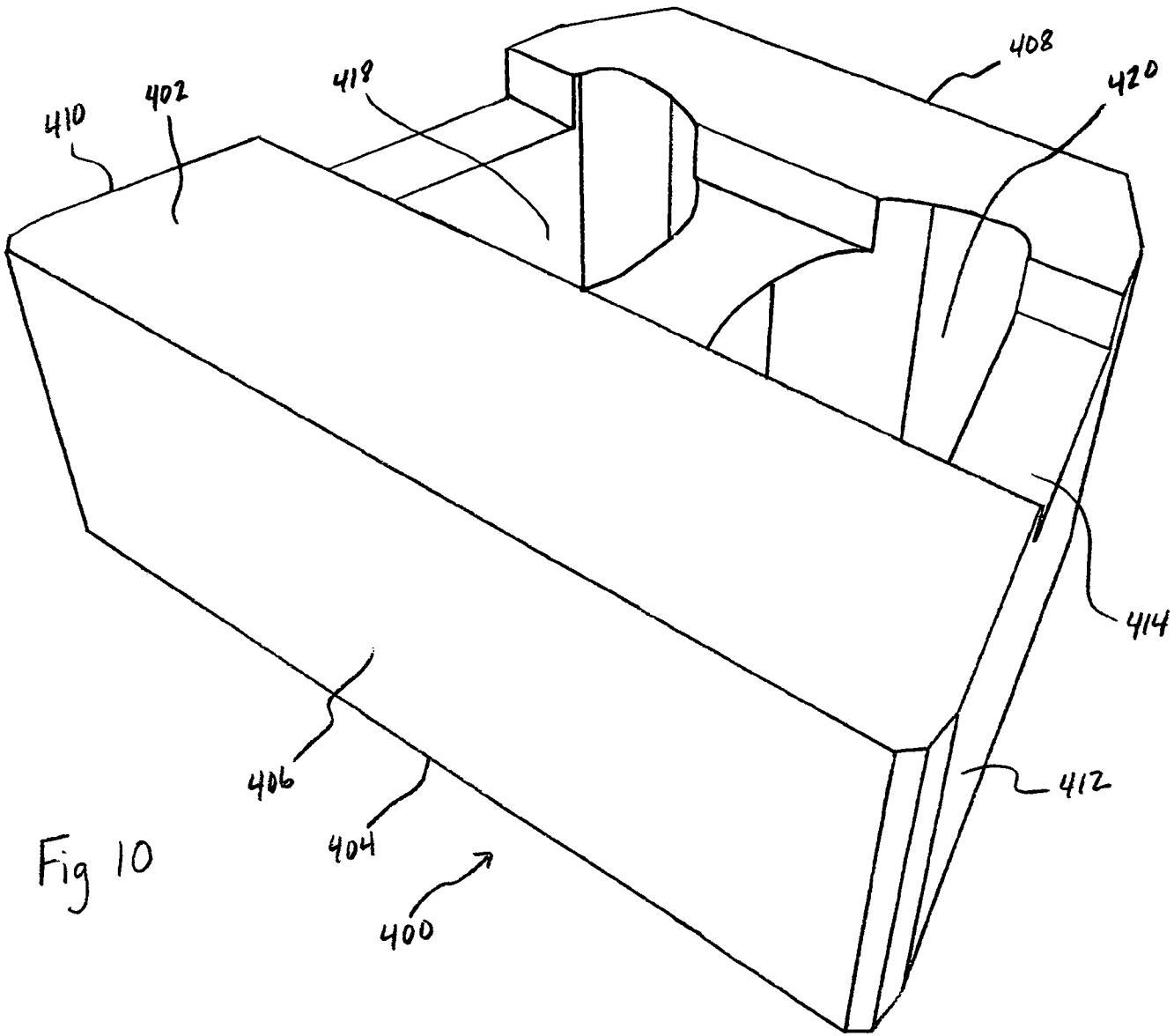
FIG. 10 is a perspective view of a modular block according to an embodiment of the present invention.
Figure 11:
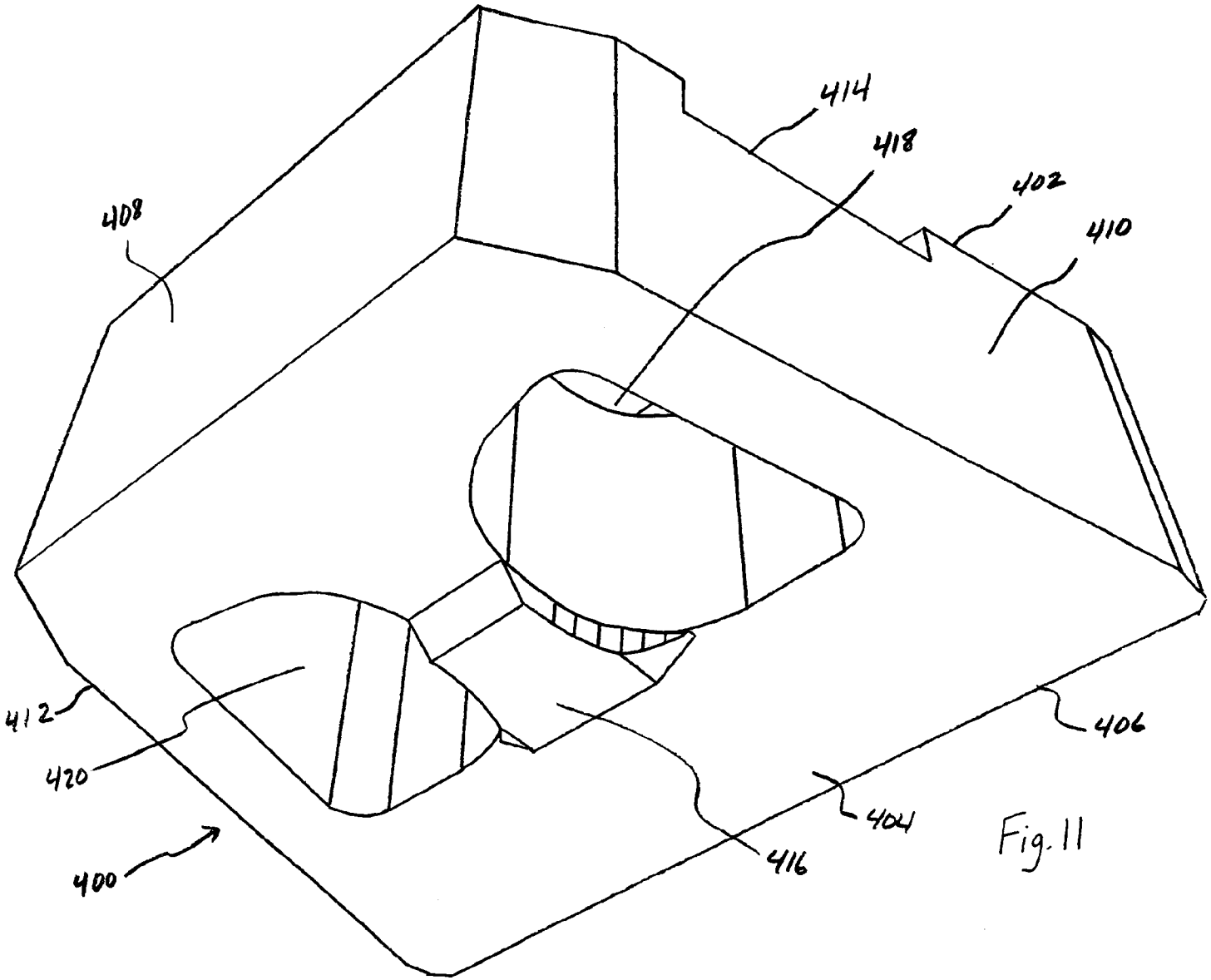
FIG. 11 is a perspective view of the modular block of FIG. 10 according to an embodiment of the present invention.
Figure 12C:
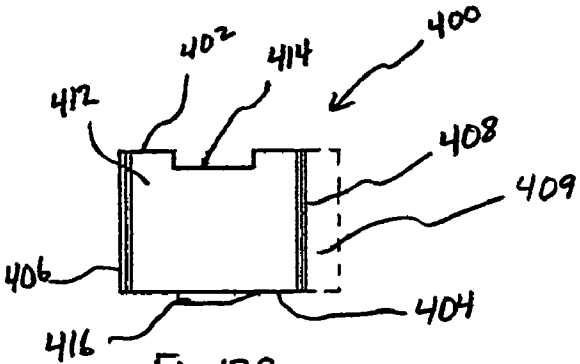
FIG. 12C is a side view of a modular block according to an embodiment of the present invention.
Figure 12B:
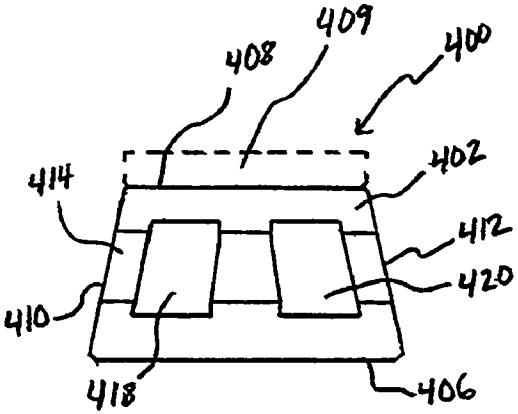
FIG. 12B is a top view.
Figure 12A:
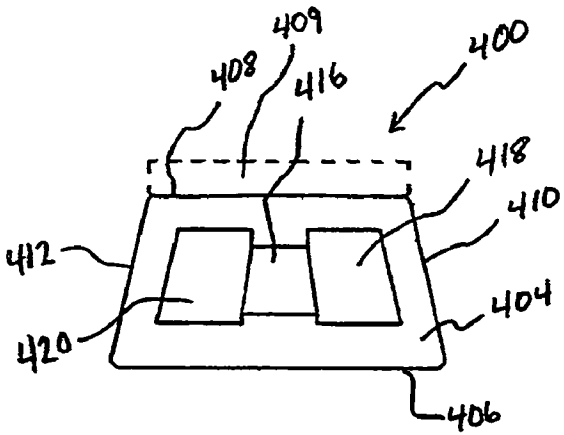
FIG. 12A is a bottom view.
Figure 13:
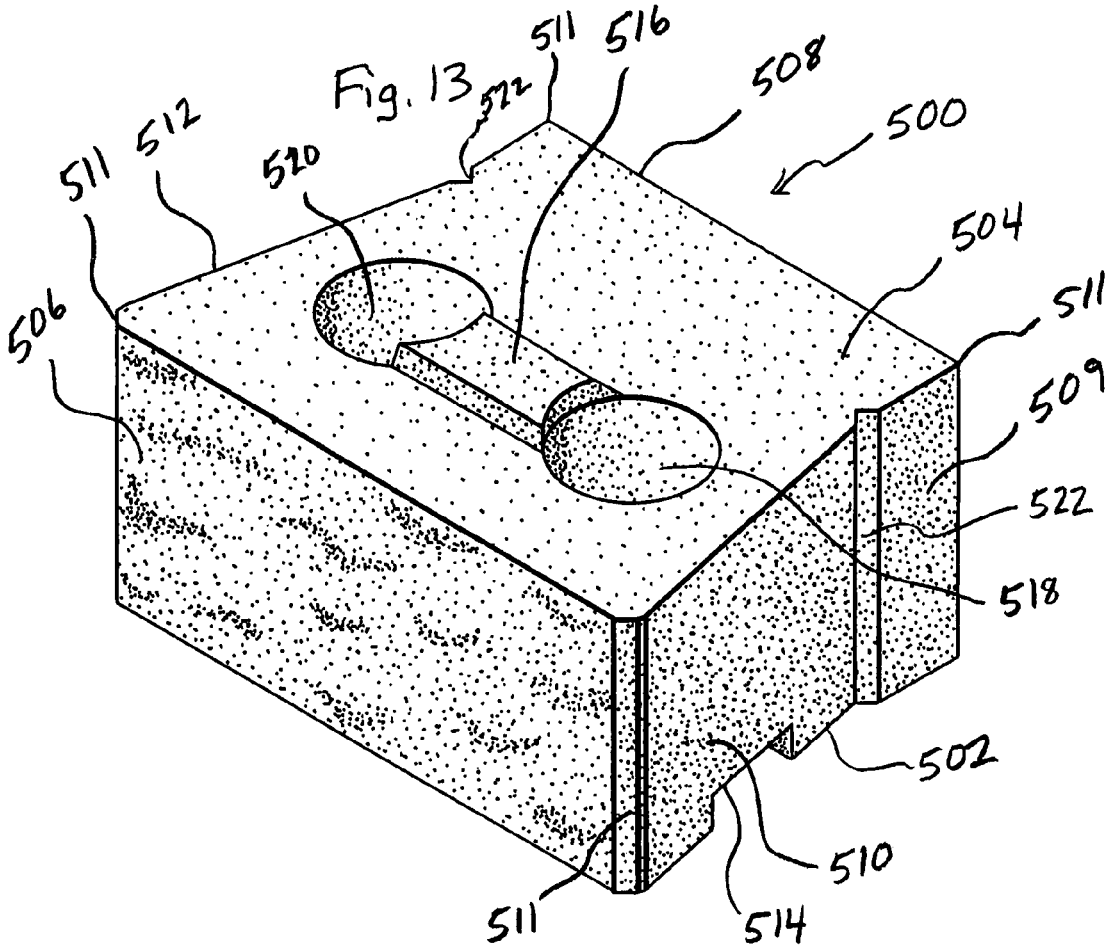
FIG. 13 is a perspective view of a modular block according to an embodiment of the present invention.
Figure 14:
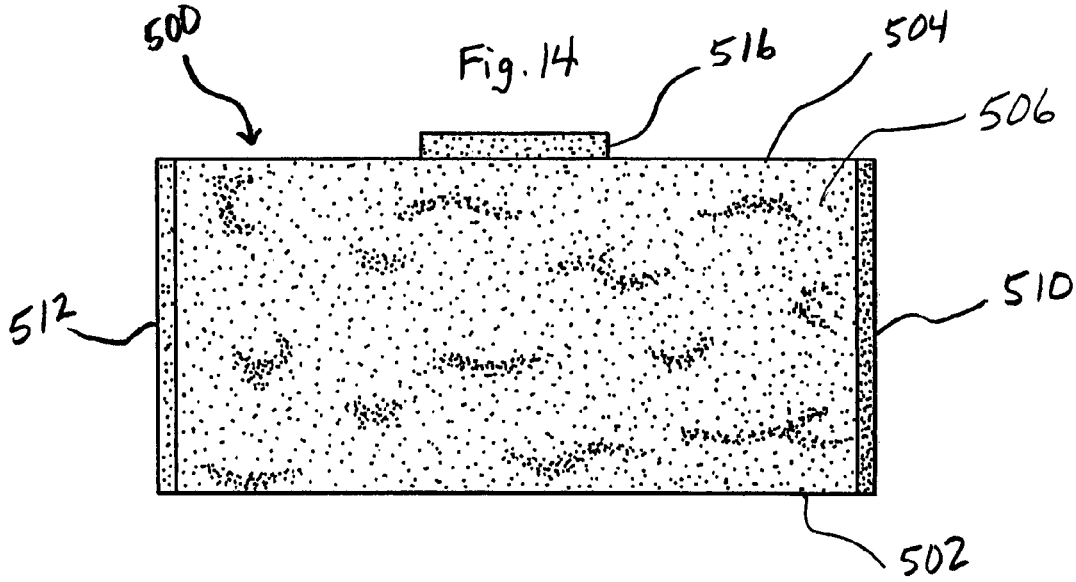
FIG. 14 is a front view of the modular block of FIG. 13 according to an embodiment of the present invention.
Figure 15:
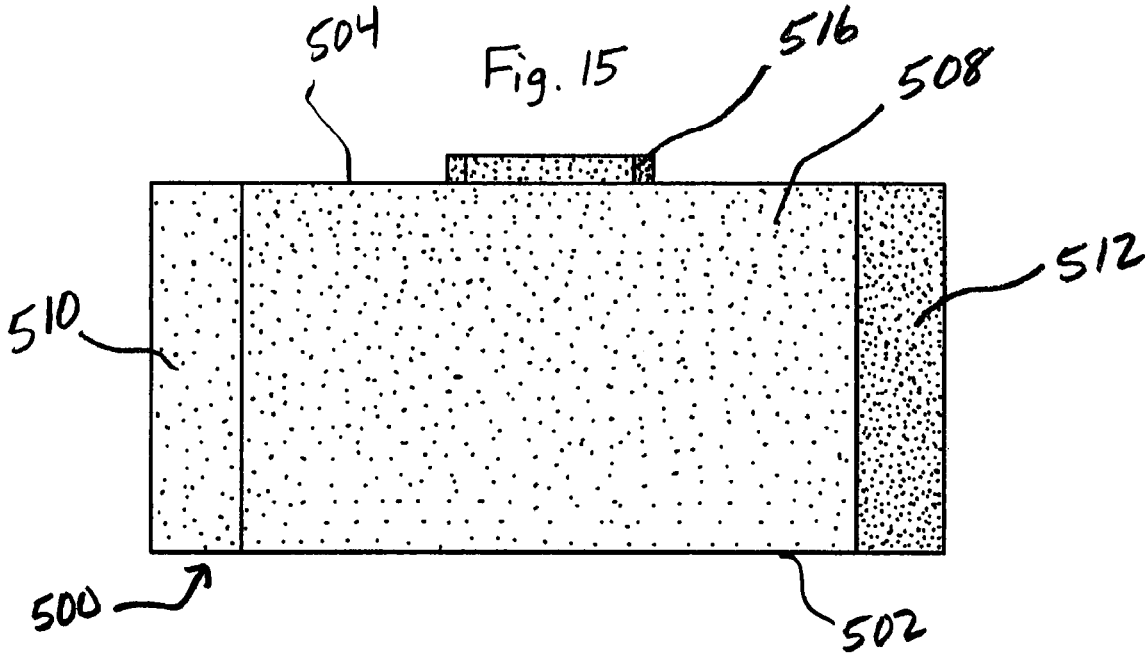
FIG. 15 is a rear view of the modular block of FIG. 13 according to an embodiment of the present invention.
Figure 16:
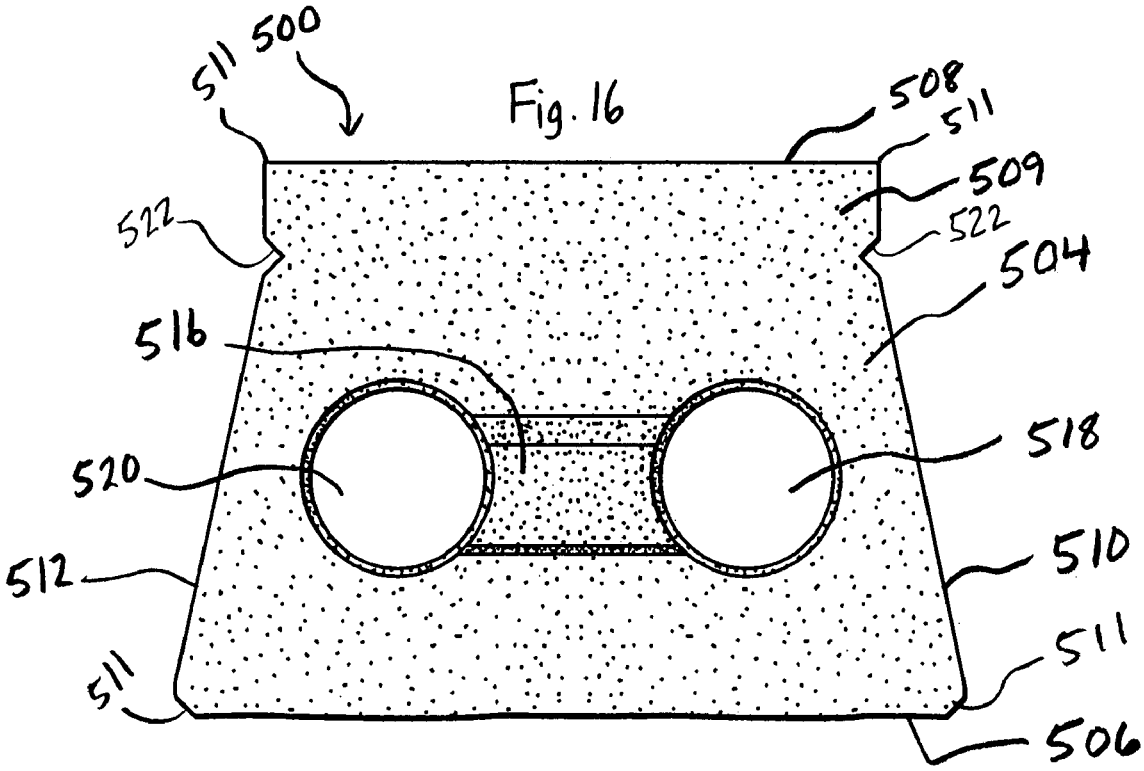
FIG. 16 is a bottom view of the modular block of FIG. 13 according to an embodiment of the present invention.
Figure 17:
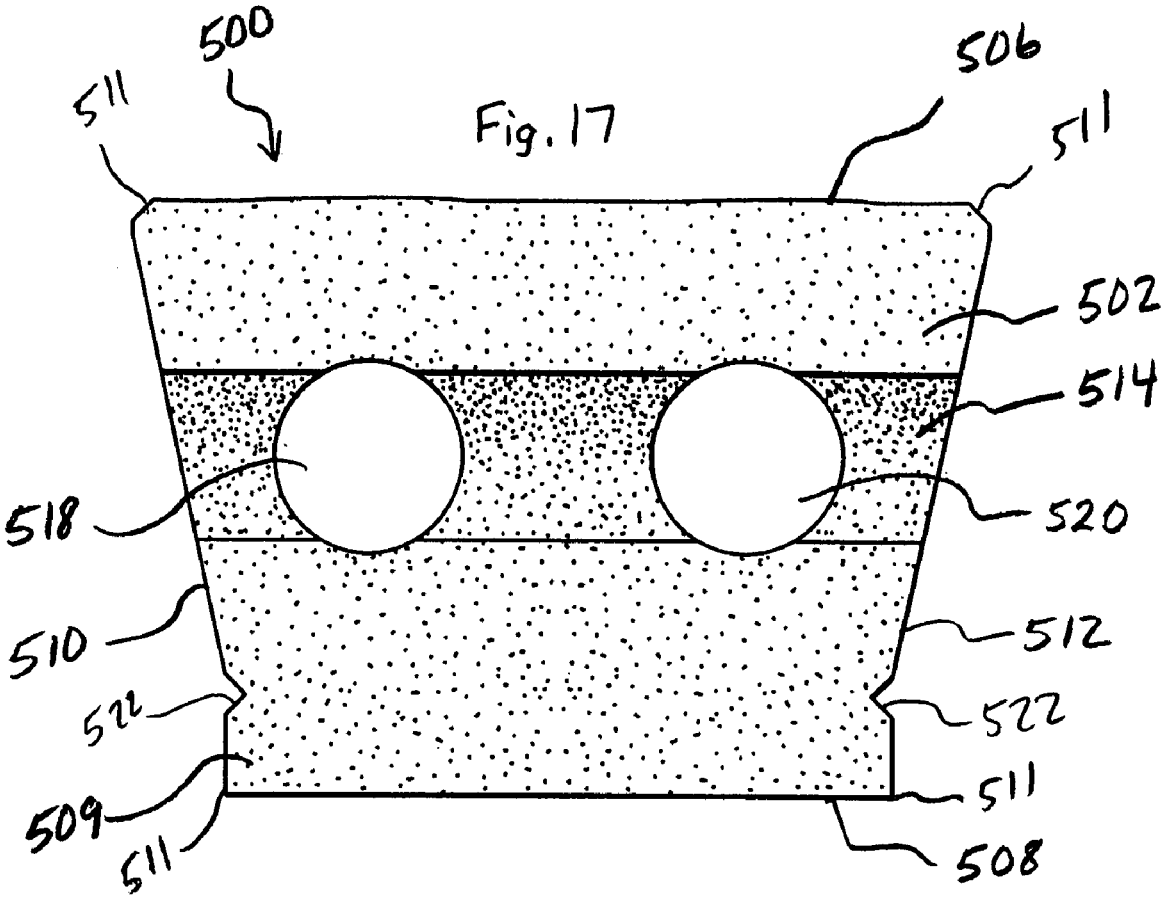
FIG. 17 is a top view of the modular block of FIG. 13 according to an embodiment of the present invention.
Figure 18:
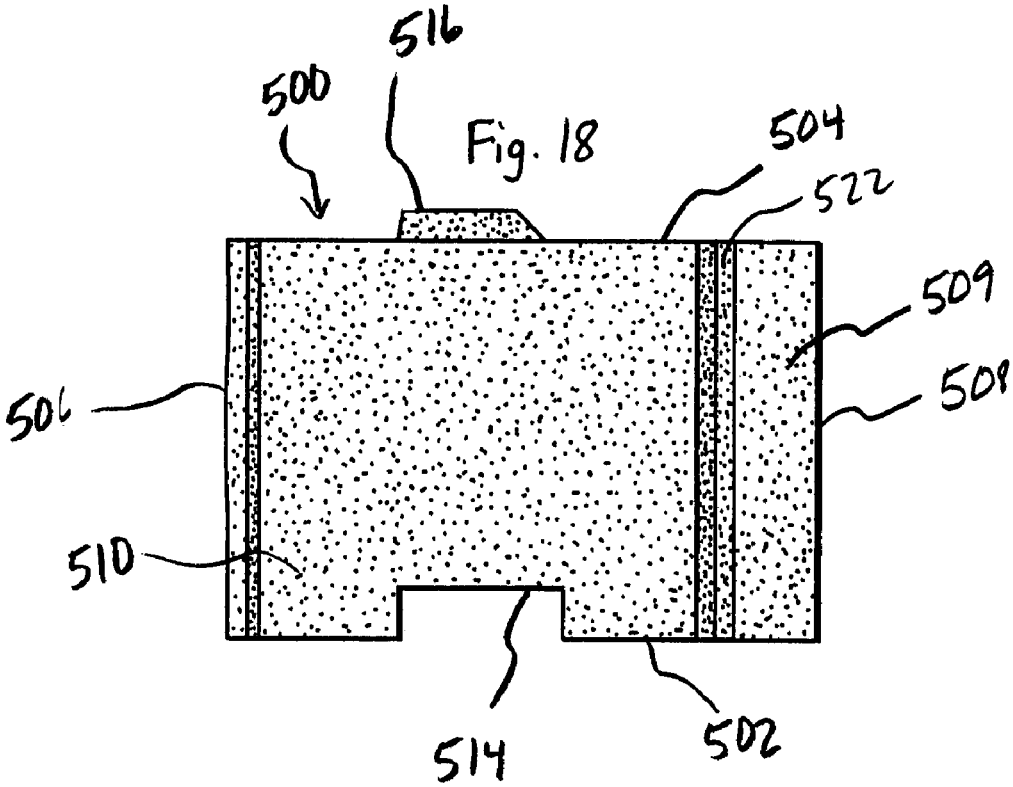
FIG. 18 is a side view of the modular block of FIG. 13 according to an embodiment of the present invention.
Figure 19:
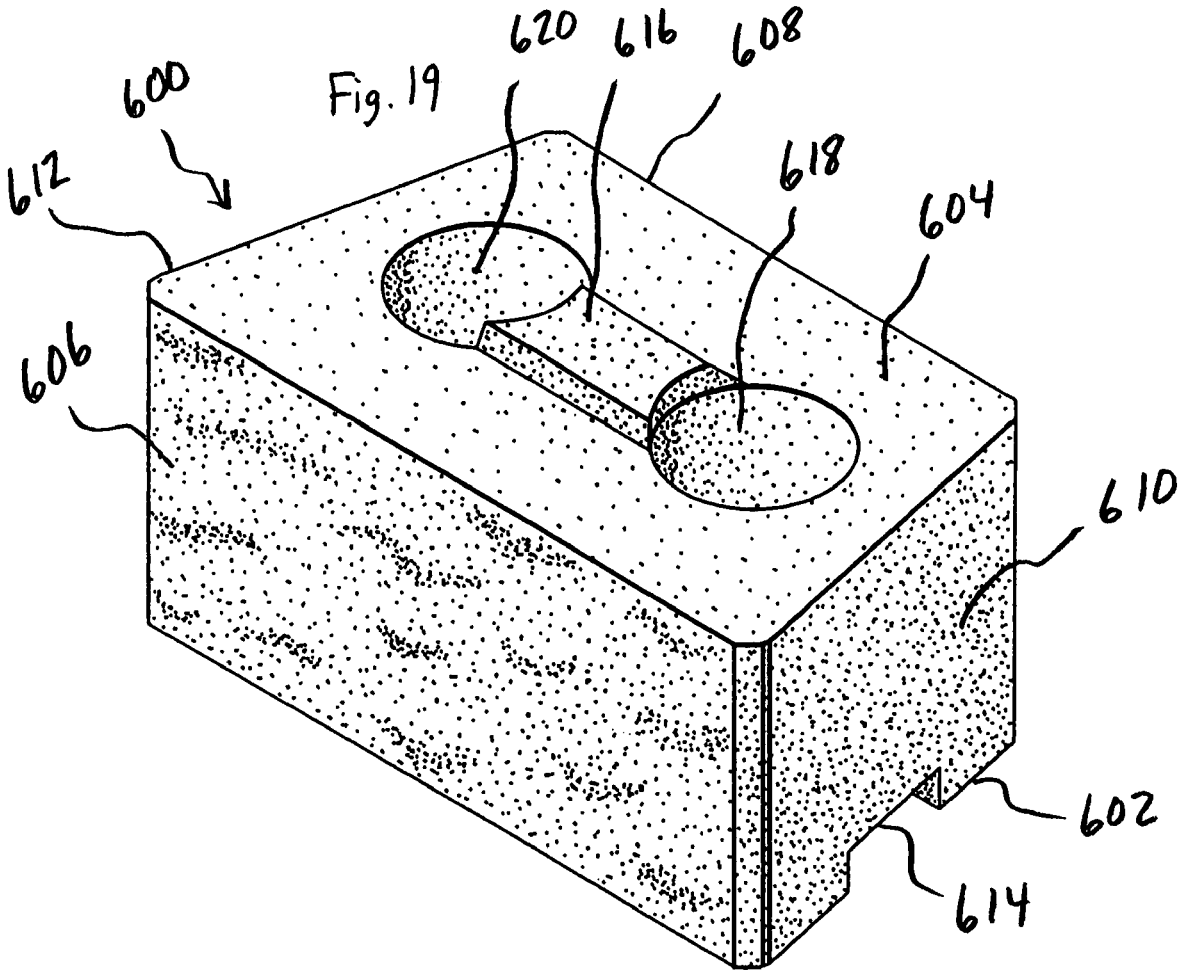
FIG. 19 is a perspective view of a modular block according to an embodiment of the present invention.
Figure 20:
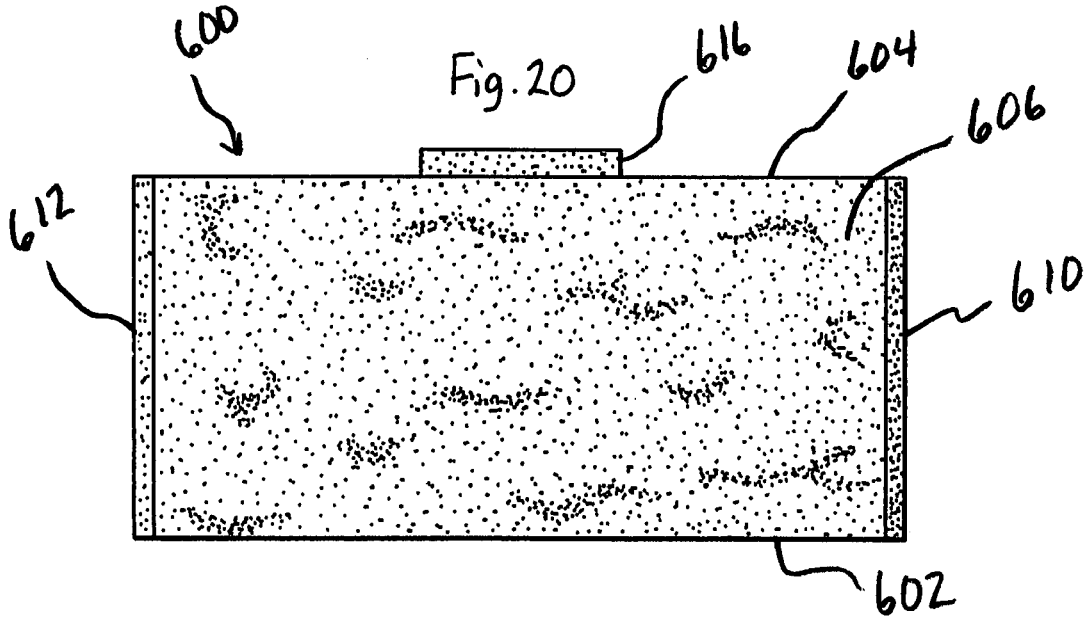
FIG. 20 is a front view of the modular block of FIG. 19 according to an embodiment of the present invention.
Figure 21:
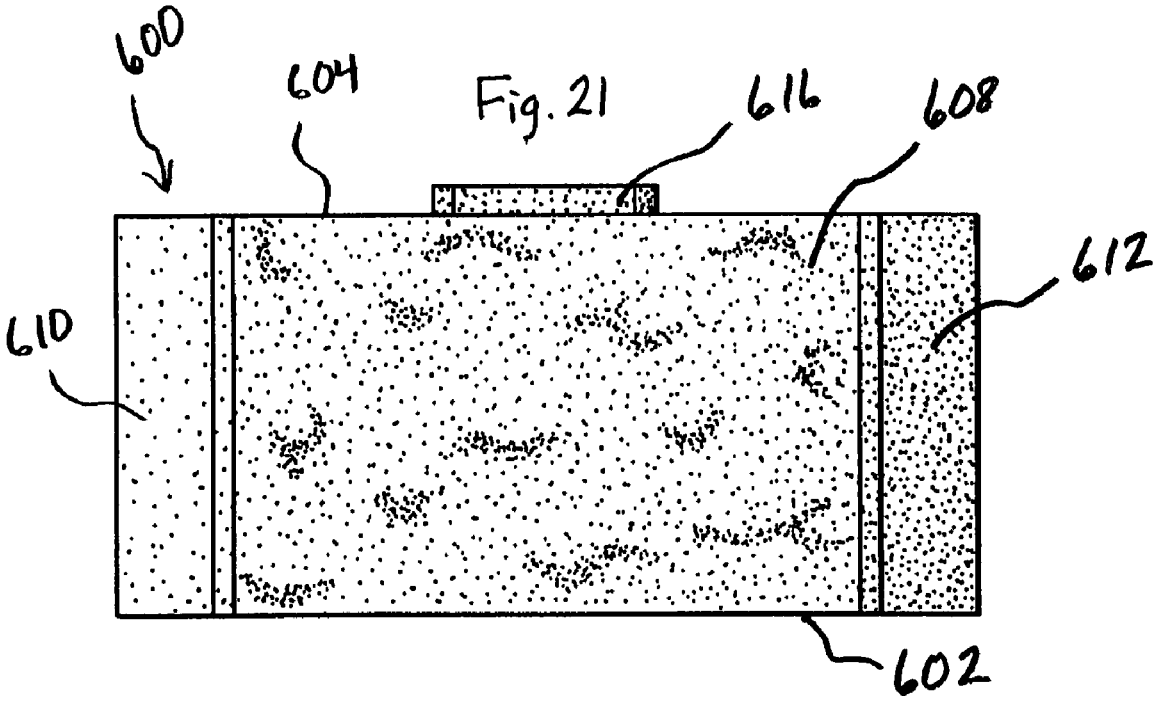
FIG. 21 is a rear view of the modular block of FIG. 19 according to an embodiment of the present invention.
Figure 22:
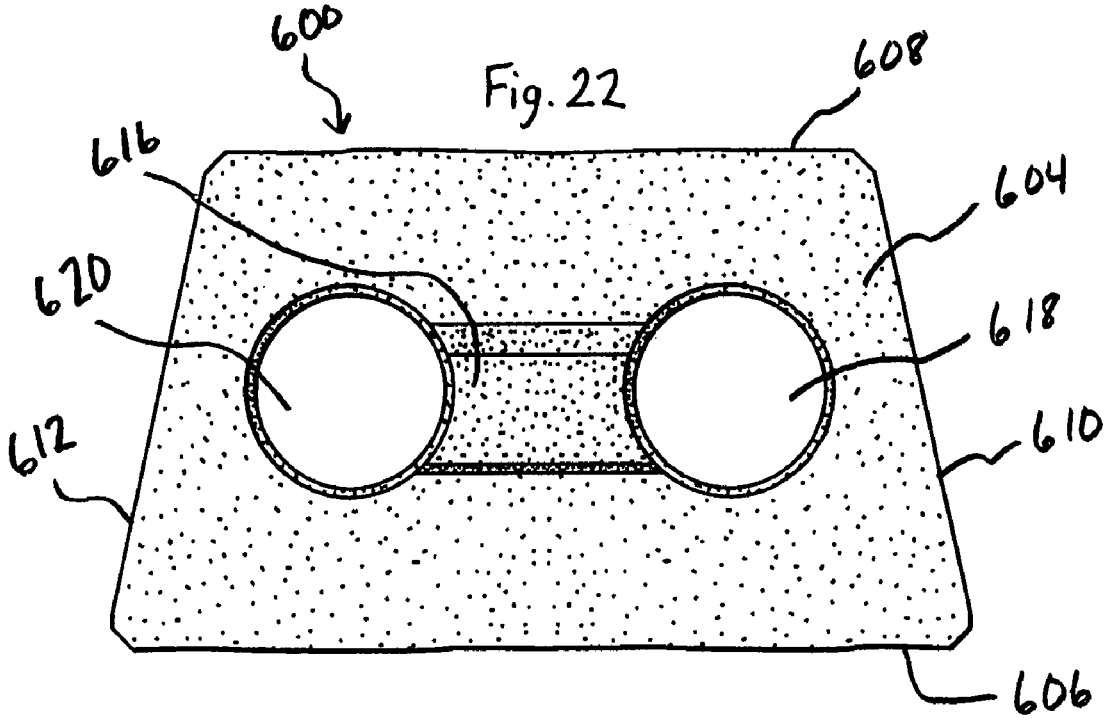
FIG. 22 is a bottom view of the modular block of FIG. 19 according to an embodiment of the present invention.
Figure 23:
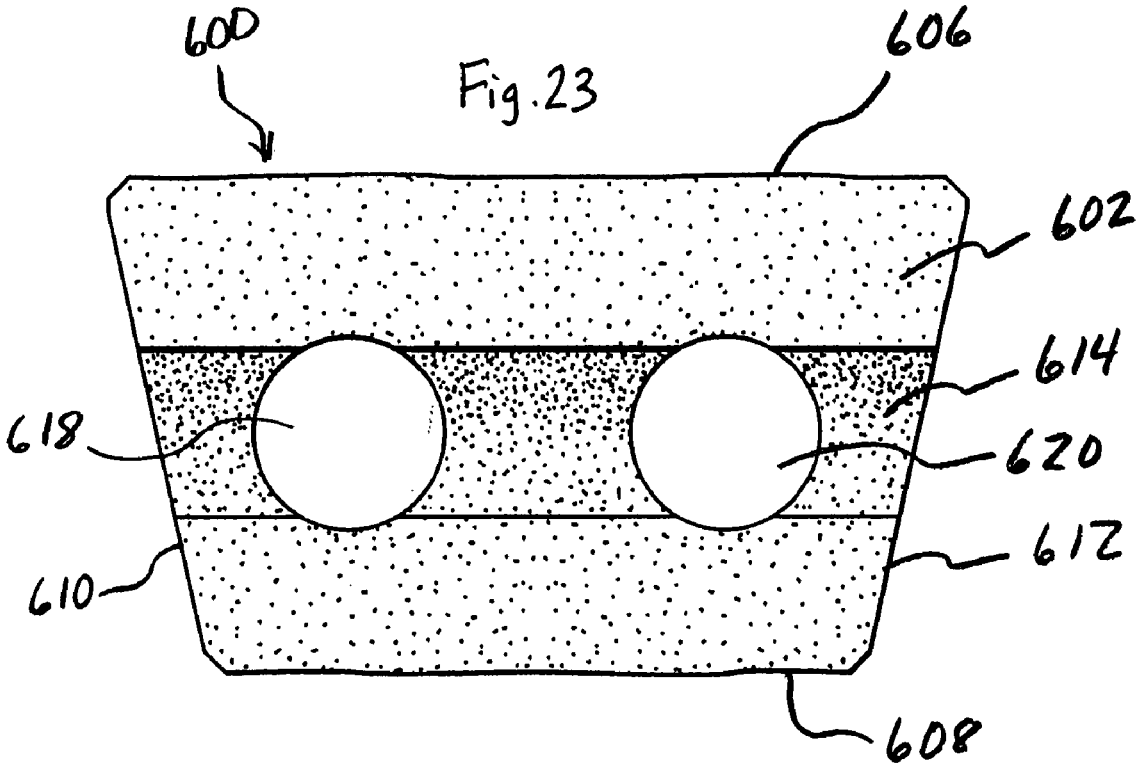
FIG. 23 is a top view of the modular block of FIG. 19 according to an embodiment of the present invention.
Figure 24:
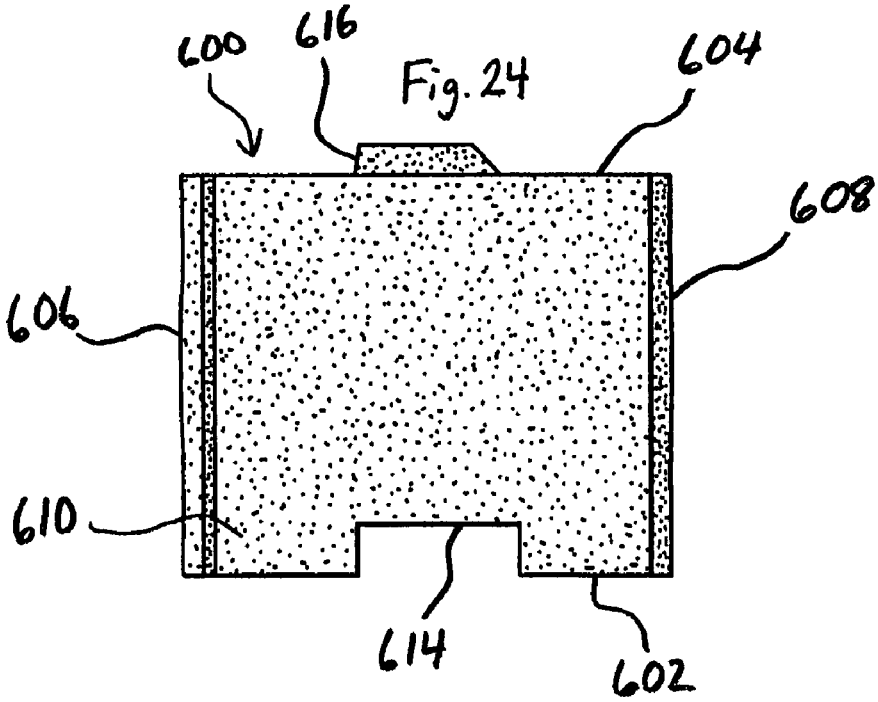
FIG. 24 is a side view of the modular block of FIG. 19 according to an embodiment of the present invention.
Figure 25:
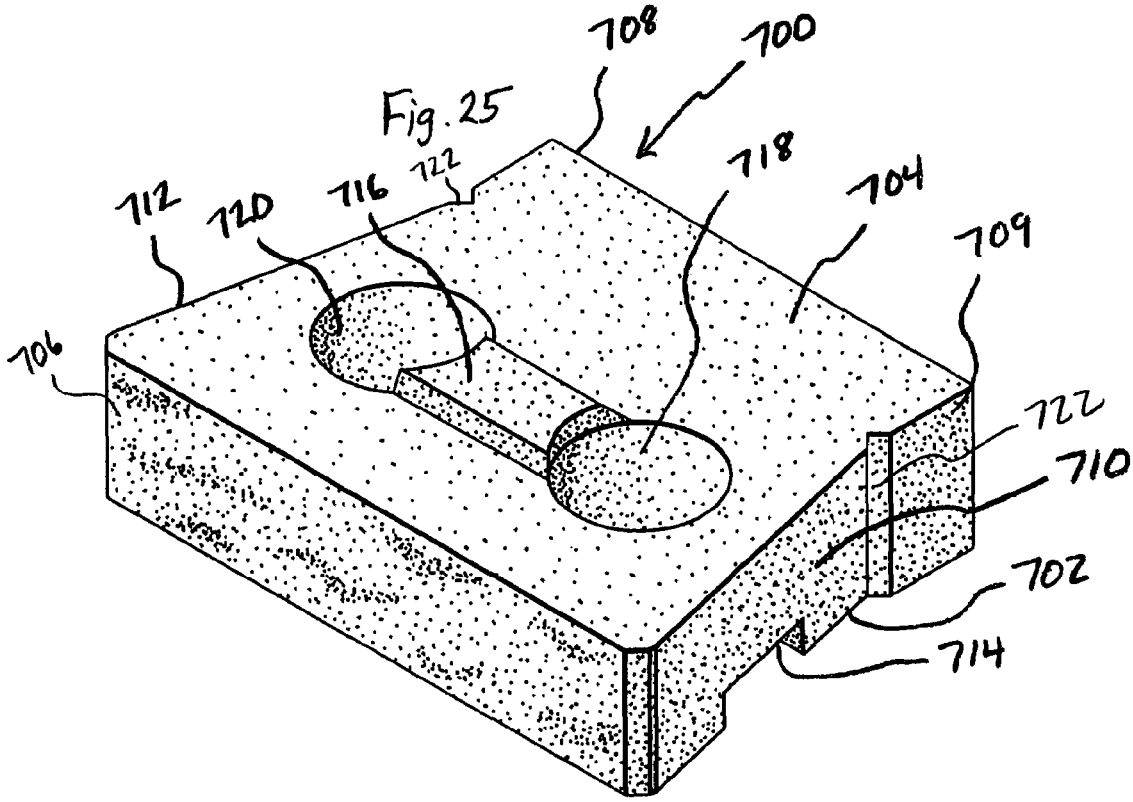
FIG. 25 is a perspective view of a modular block according to an embodiment of the present invention.
Figure 26:
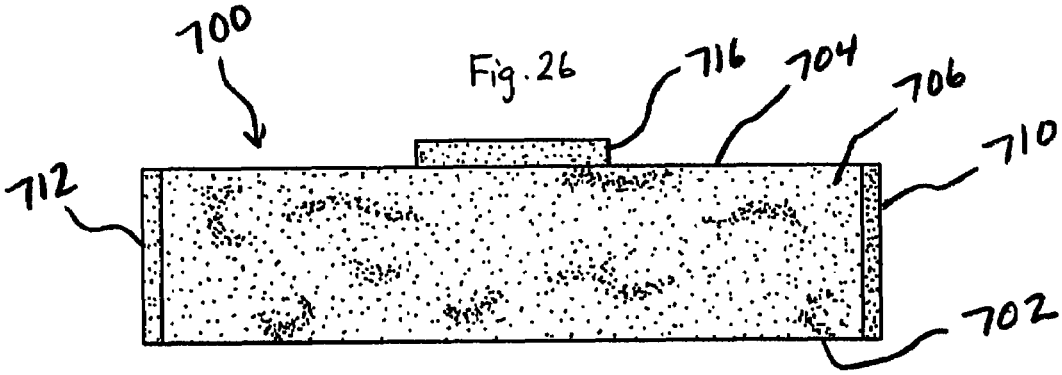
FIG. 26 is a front view of the modular block of FIG. 25 according to an embodiment of the present invention.
Figure 27:
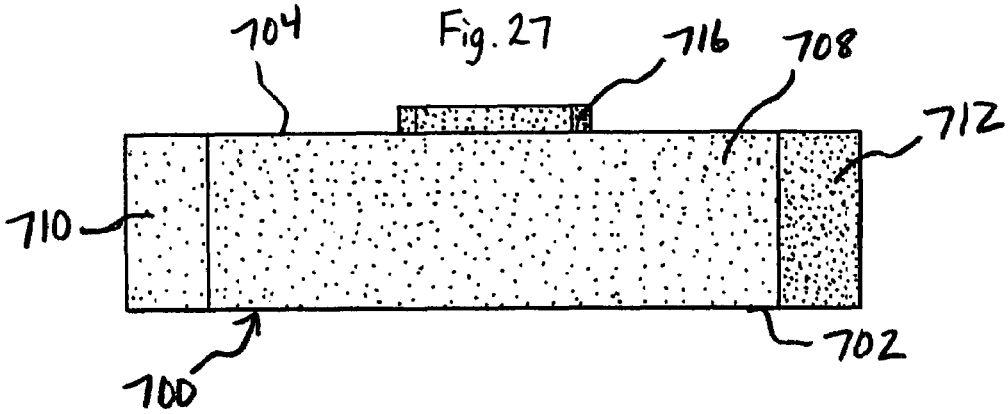
FIG. 27 is a rear view of the modular block of FIG. 25 according to an embodiment of the present invention.
Figure 28:
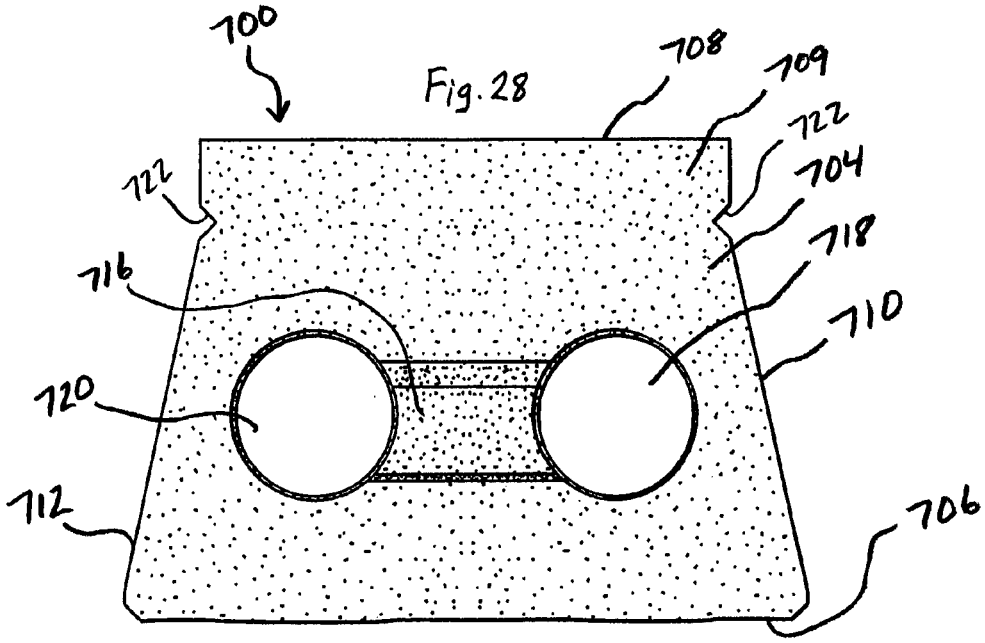
FIG. 28 is a bottom view of the modular block of FIG. 25 according to an embodiment of the present invention.
Figure 29:
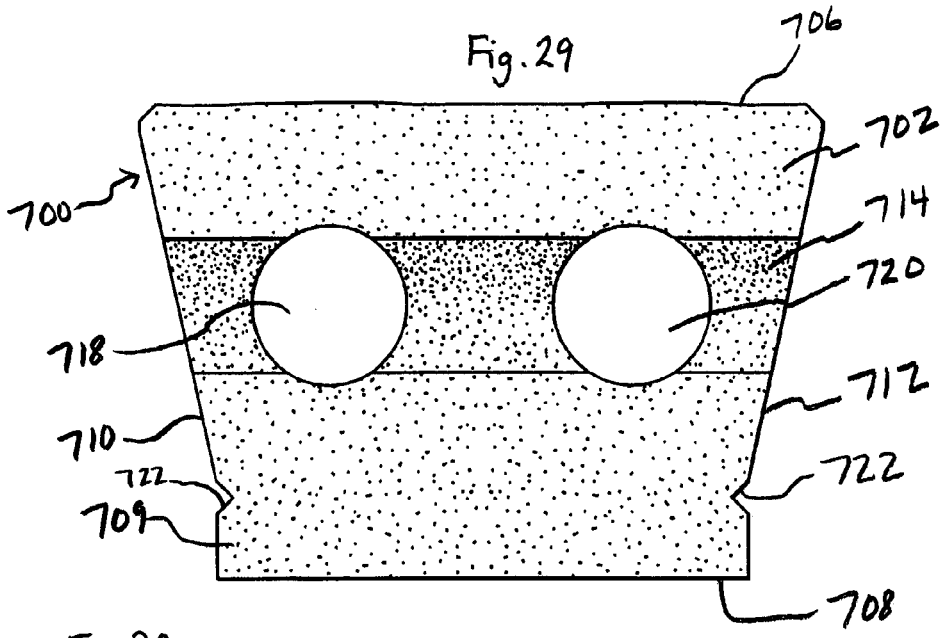
FIG. 29 is a top view of the modular block of FIG. 25 according to an embodiment of the present invention.
Figure 30:
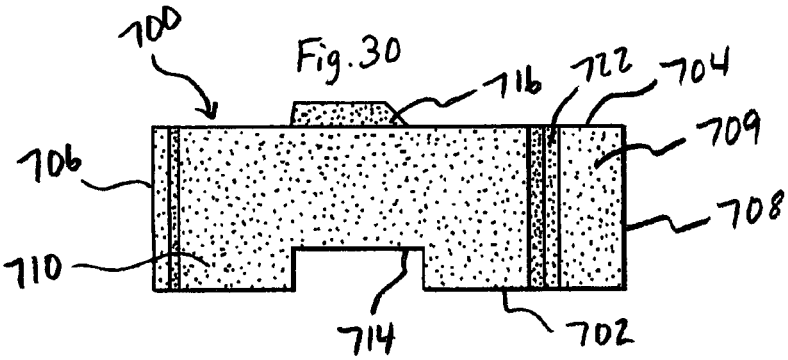
FIG. 30 is a side view of the modular block of FIG. 25 according to an embodiment of the present invention.
Figure 31:
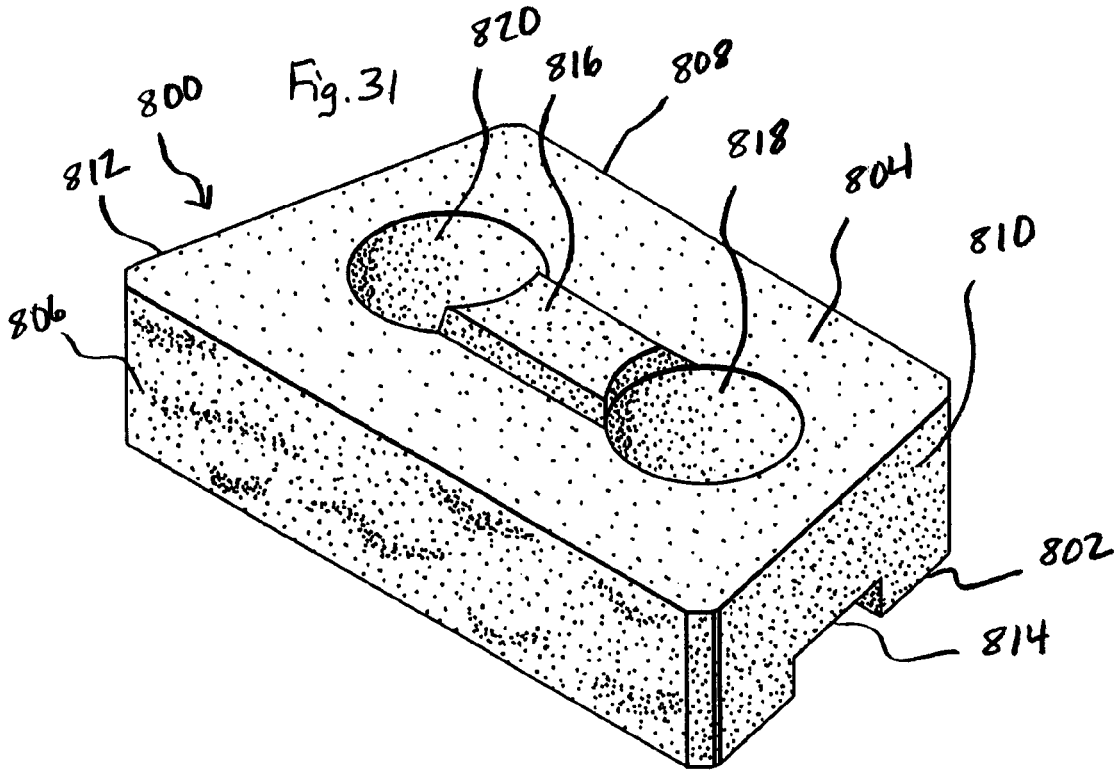
FIG. 31 is a perspective view of a modular block according to an embodiment of the present invention.
Figure 32:
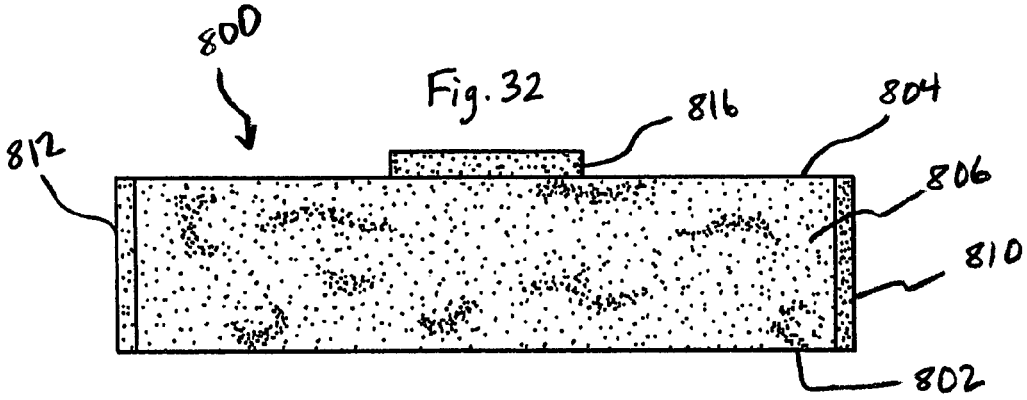
FIG. 32 is a front view of the modular block of FIG. 31 according to an embodiment of the present invention.
Figure 33:
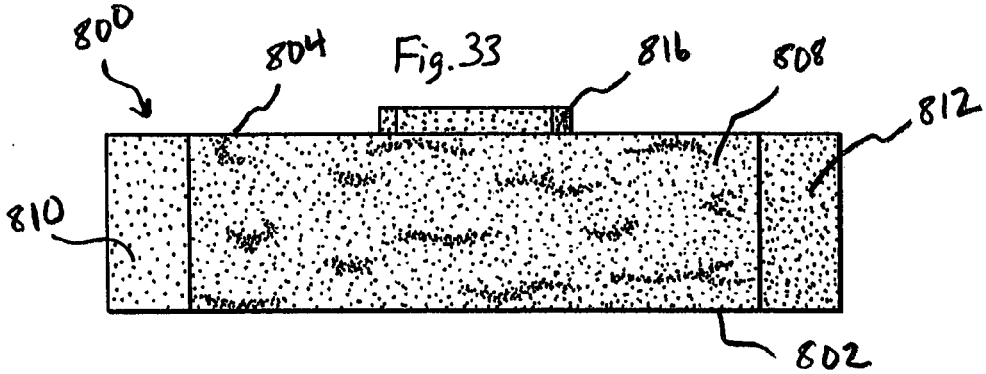
FIG. 33 is a rear view of the modular block of FIG. 31 according to an embodiment of the present invention.
Figure 34:
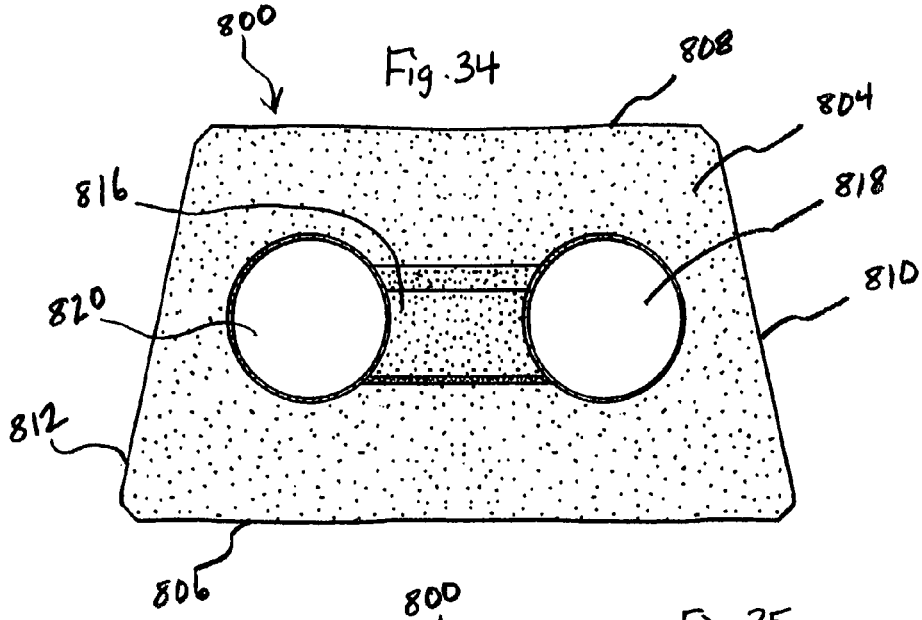
FIG. 34 is a bottom view of the modular block of FIG. 31 according to an embodiment of the present invention.
Figure 35:
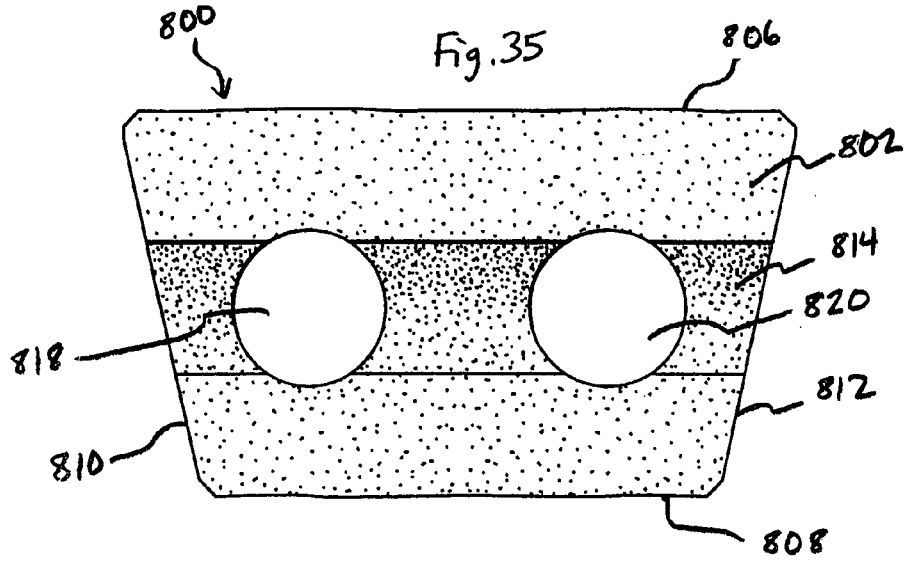
FIG. 35 is a top view of the modular block of FIG. 31 according to an embodiment of the present invention.
Figure 36:
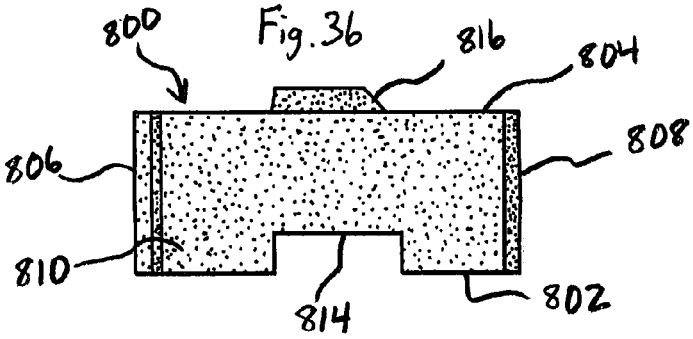
FIG. 36 is a side view of the modular block of FIG. 31 according to an embodiment of the present invention.
Figure 37:
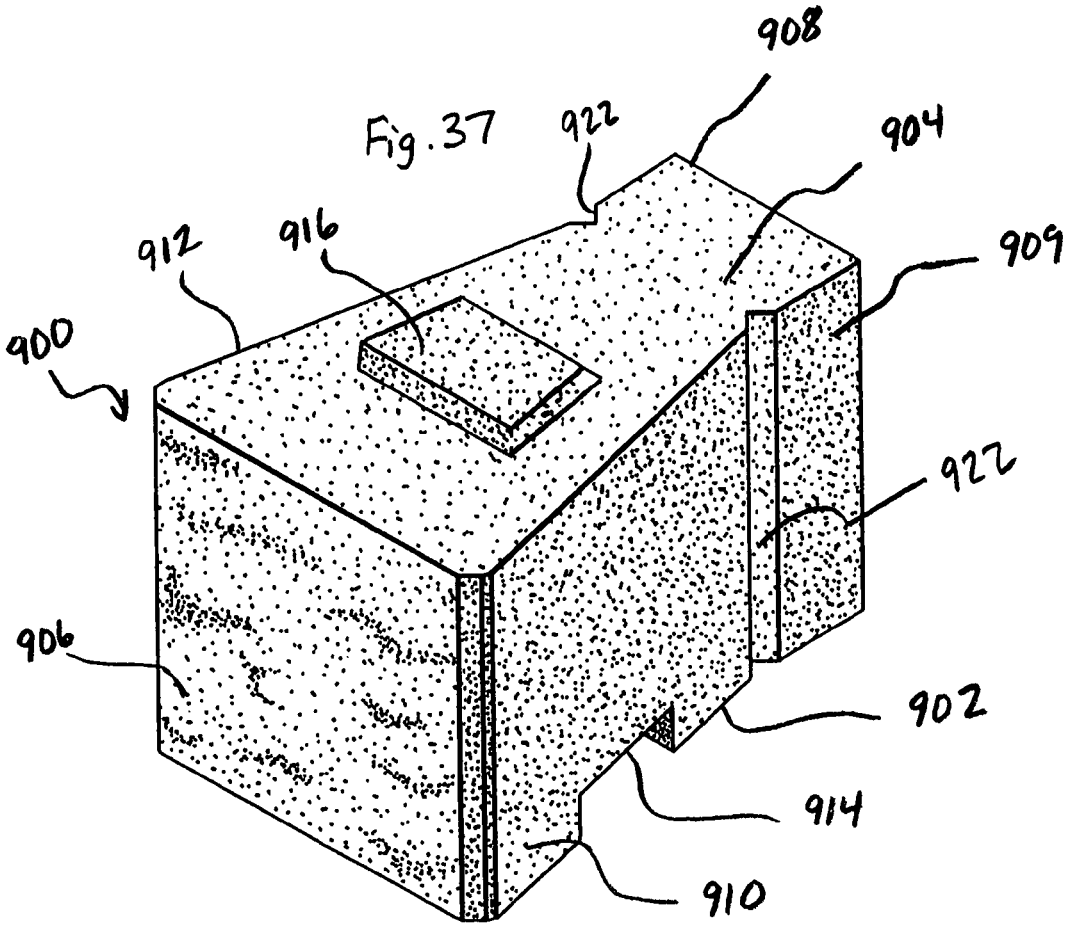
FIG. 37 is a perspective view of a modular block according to an embodiment of the present invention.
Figure 38:
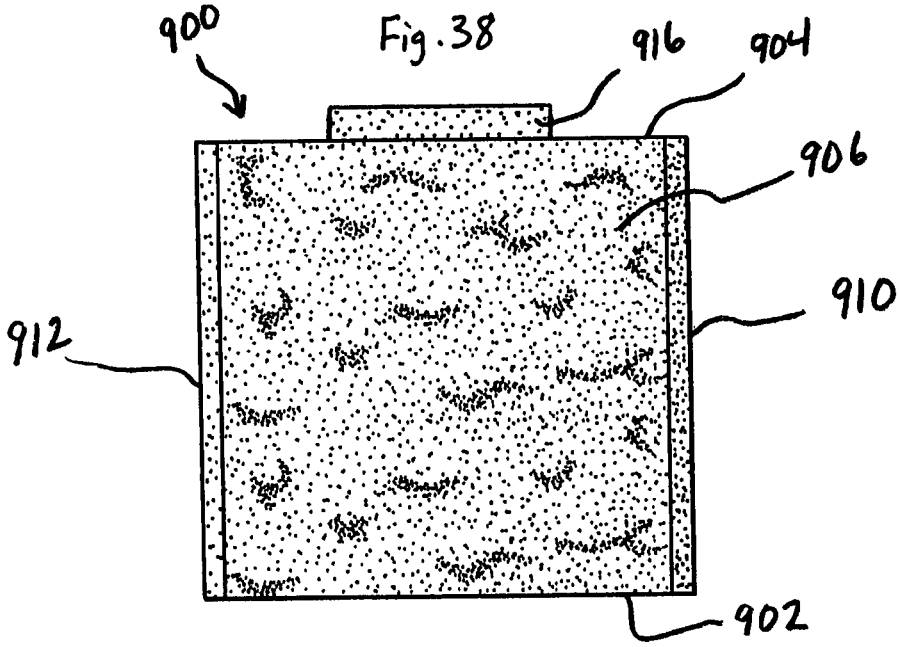
FIG. 38 is a front view of the modular block of FIG. 37 according to an embodiment of the present invention.
Figure 39:
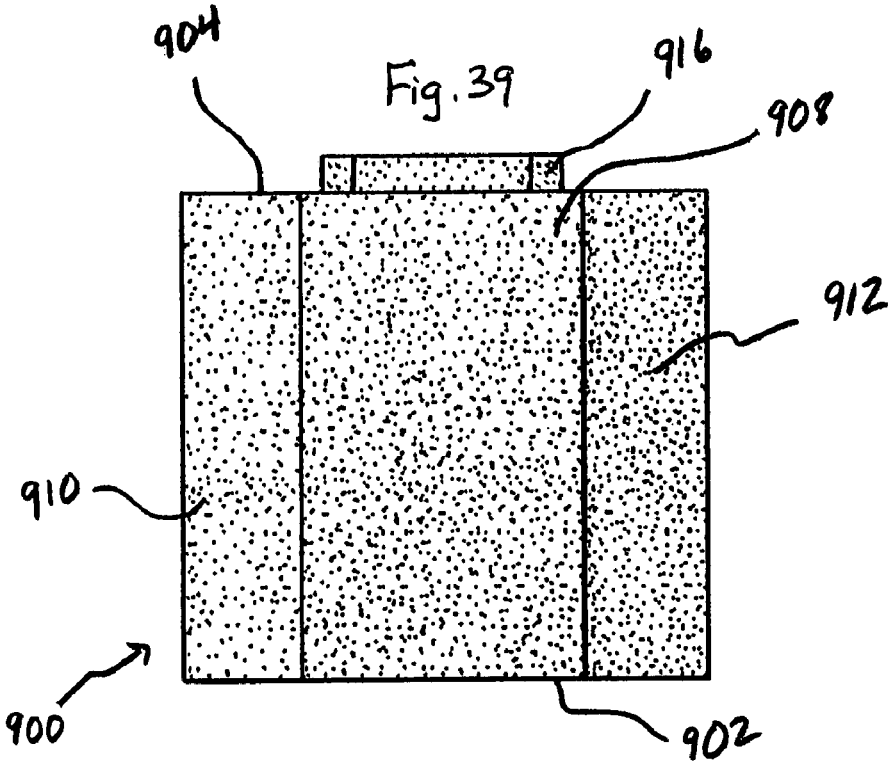
FIG. 39 is a rear view of the modular block of FIG. 37 according to an embodiment of the present invention.
Figure 40:
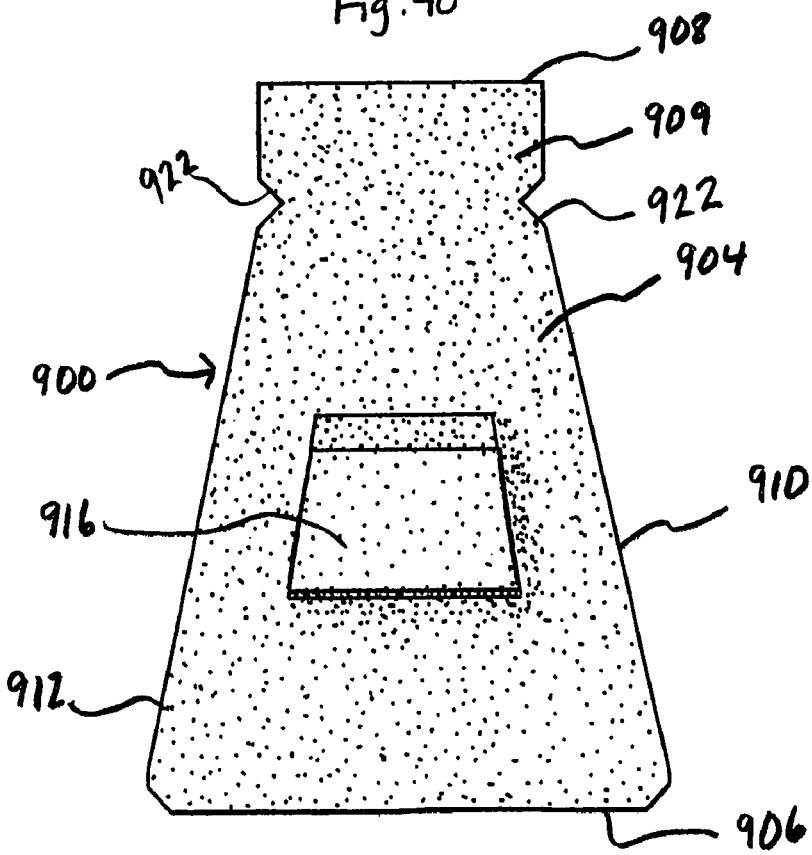
FIG. 40 is a bottom view of the modular block of FIG. 37 according to an embodiment of the present invention.
Figure 41:
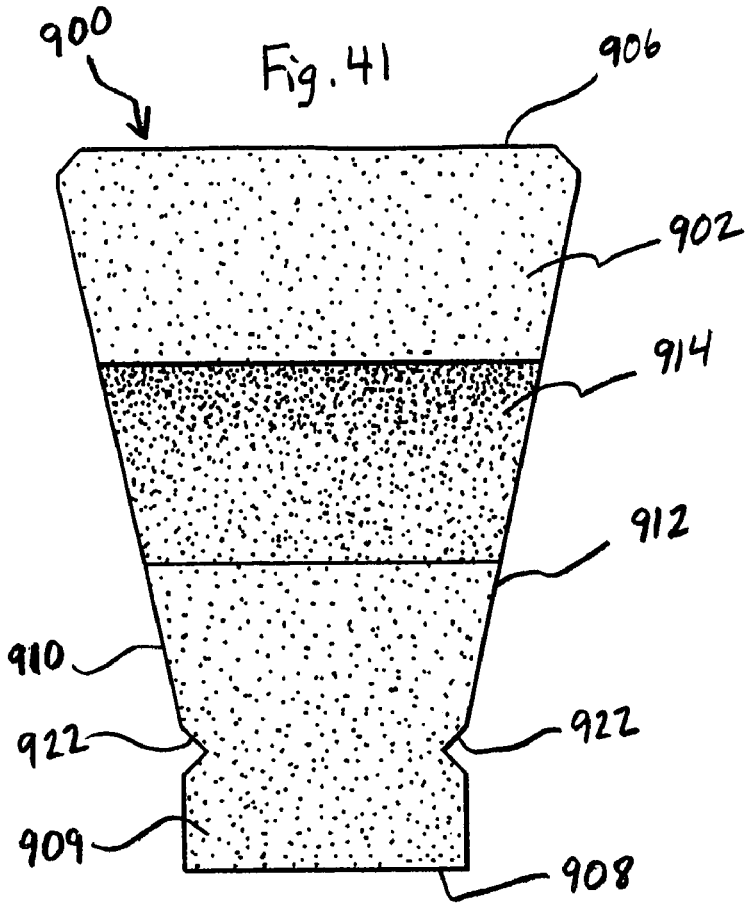
FIG. 41 is a top view of the modular block of FIG. 37 according to an embodiment of the present invention.
Figure 42:
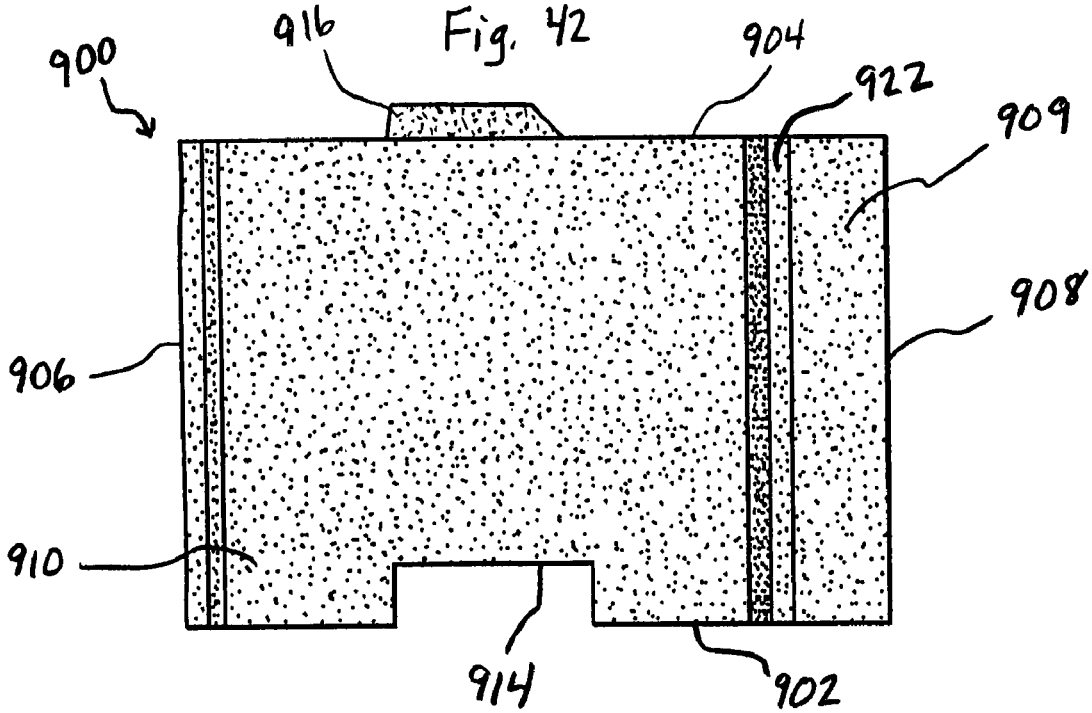
FIG. 42 is a side view of the modular block of FIG. 37 according to an embodiment of the present invention.
Figure 43:
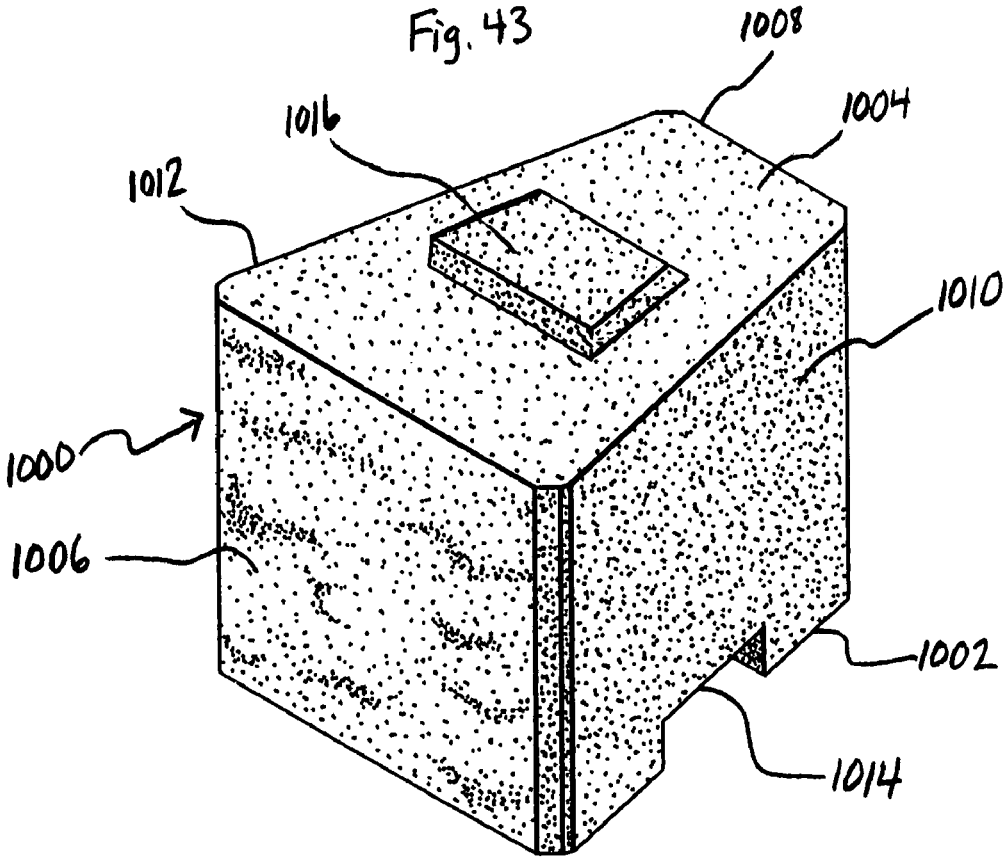
FIG. 43 is a perspective view of a modular block according to an embodiment of the present invention.
Figure 44:
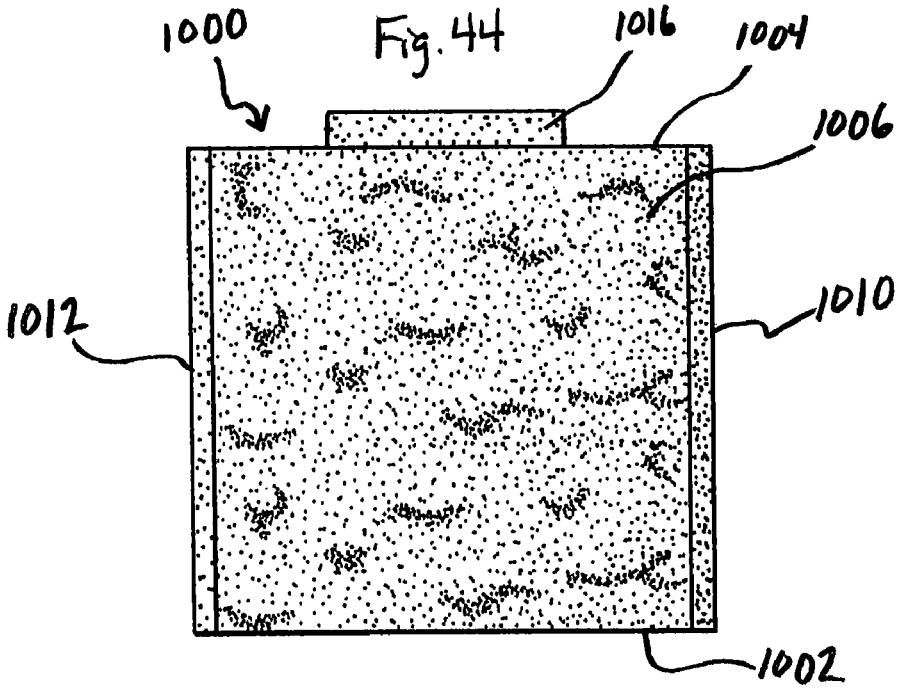
FIG. 44 is a front view of the modular block of FIG. 43 according to an embodiment of the present invention.
Figure 45:
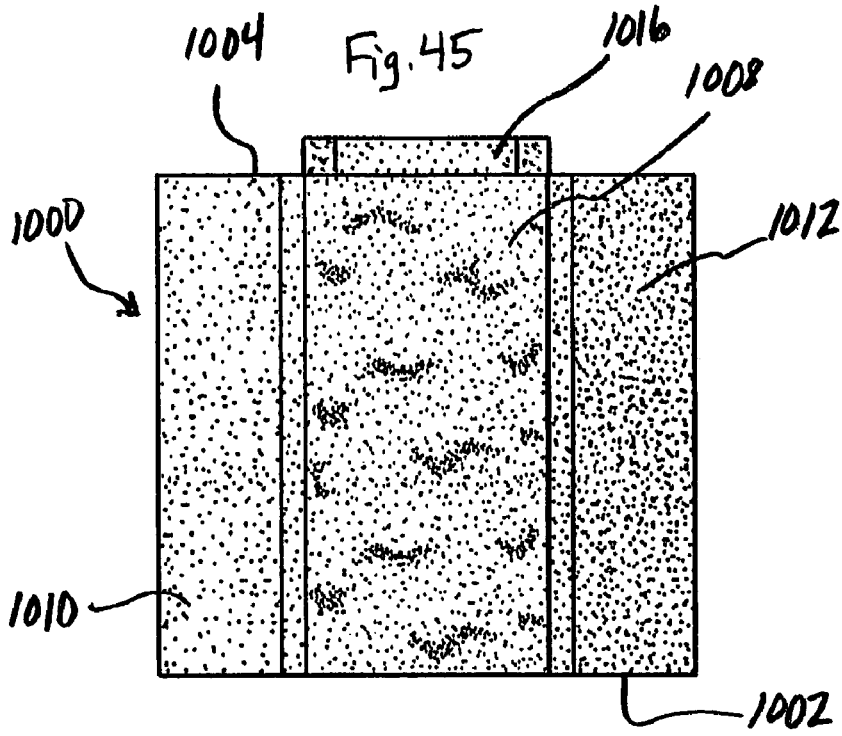
FIG. 45 is a rear view of the modular block of FIG. 43 according to an embodiment of the present invention.
Figure 46:
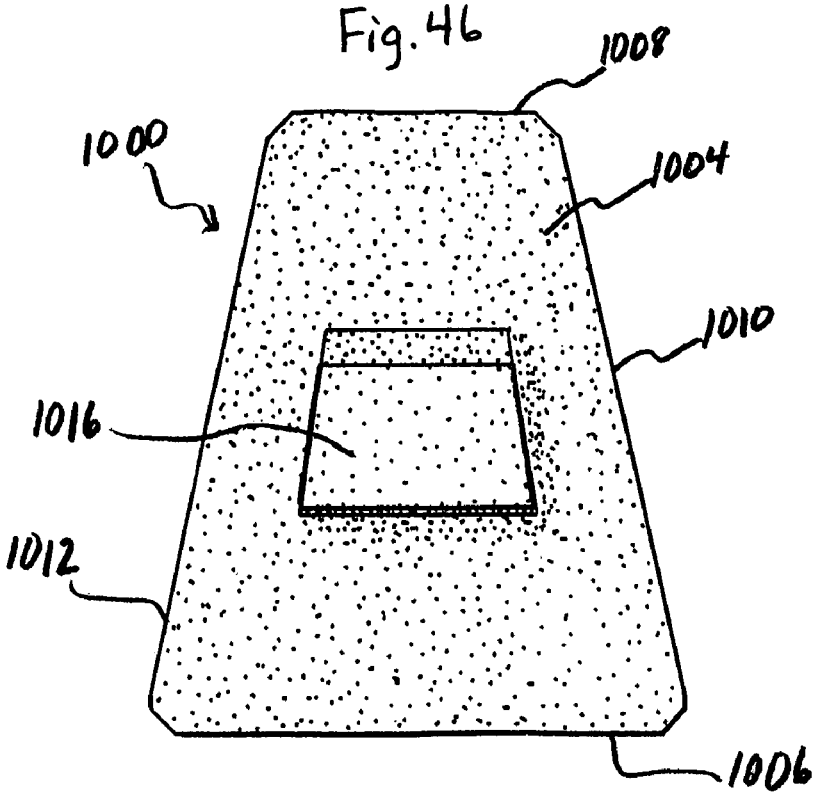
FIG. 46 is a bottom view of the modular block of FIG. 43 according to an embodiment of the present invention.
Figure 47:
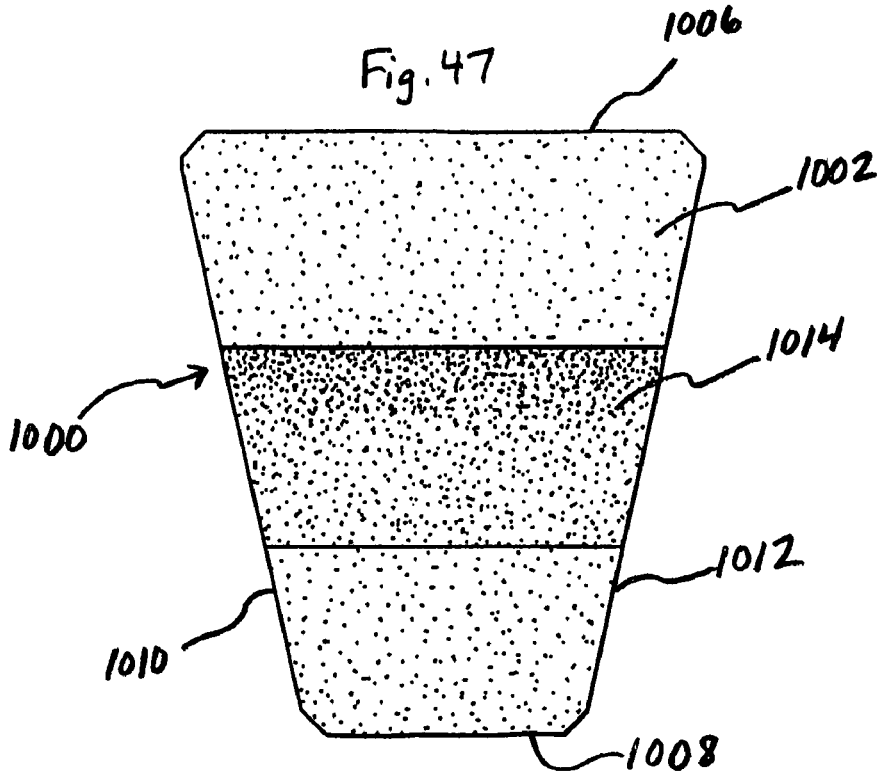
FIG. 47 is a top view of the modular block of FIG. 43 according to an embodiment of the present invention.
Figure 48:
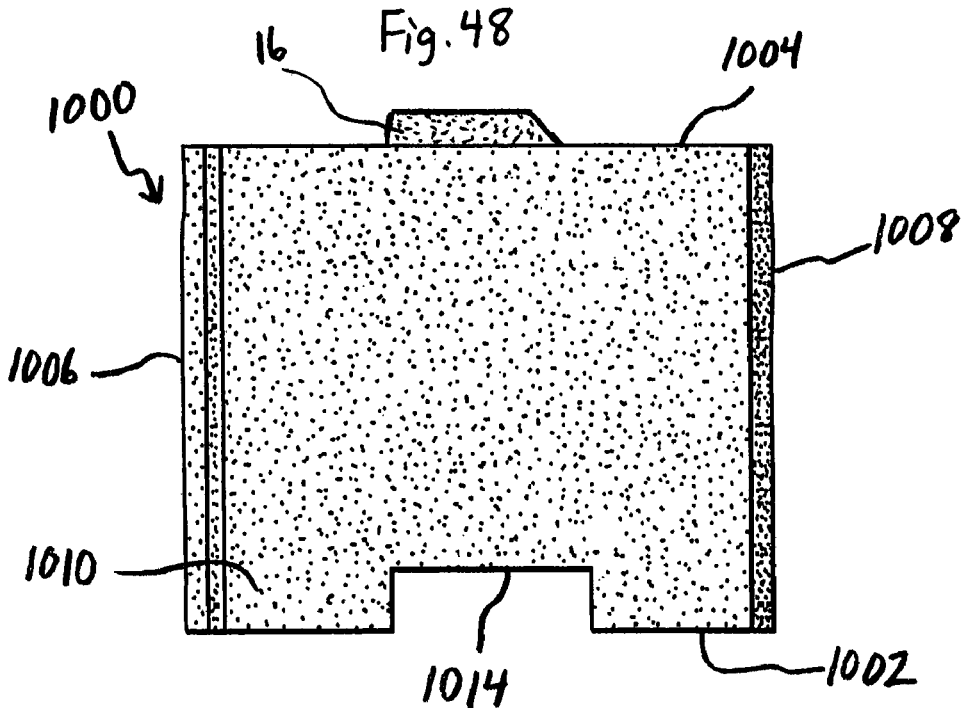
FIG. 48 is a side view of the modular block of FIG. 43 according to an embodiment of the present invention.
Figure 49:
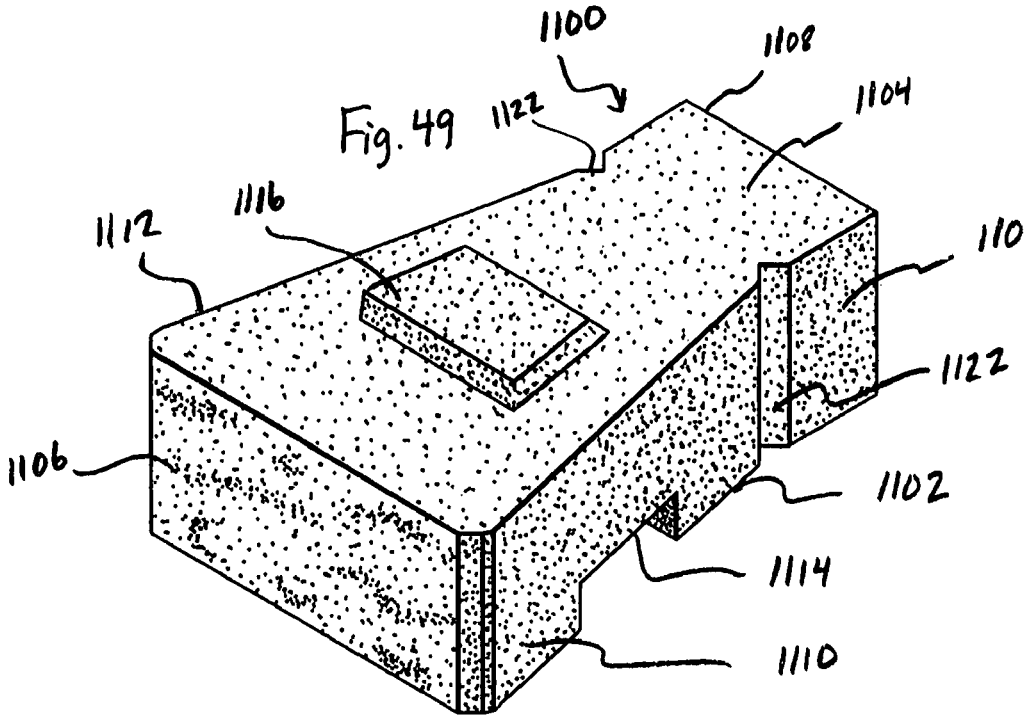
FIG. 49 is a perspective view of a modular block according to an embodiment of the present invention.
Figure 50:
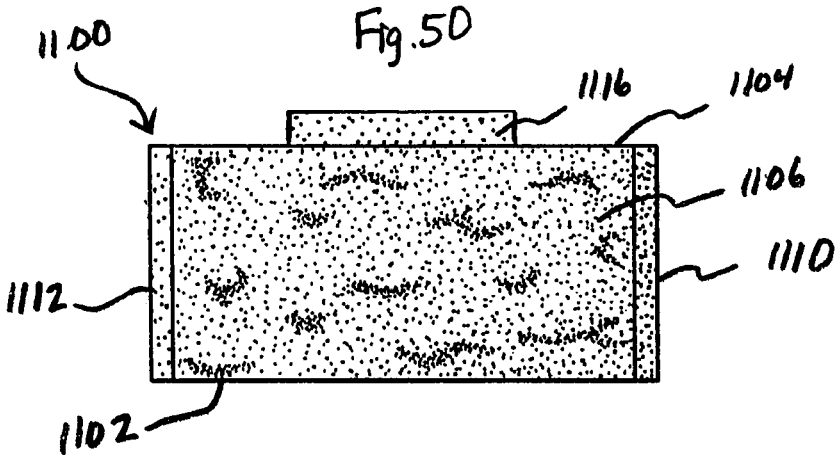
FIG. 50 is a front view of the modular block of FIG. 49 according to an embodiment of the present invention.
Figure 51:
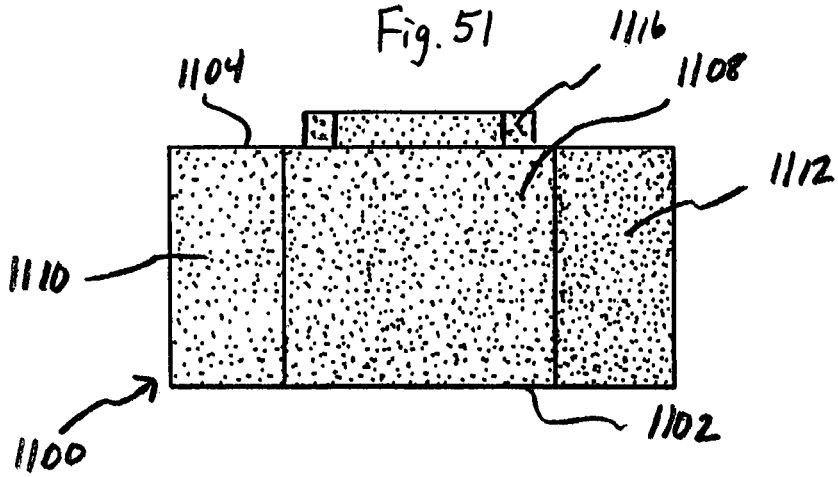
FIG. 51 is a rear view of the modular block of FIG. 49 according to an embodiment of the present invention.
Figure 52:
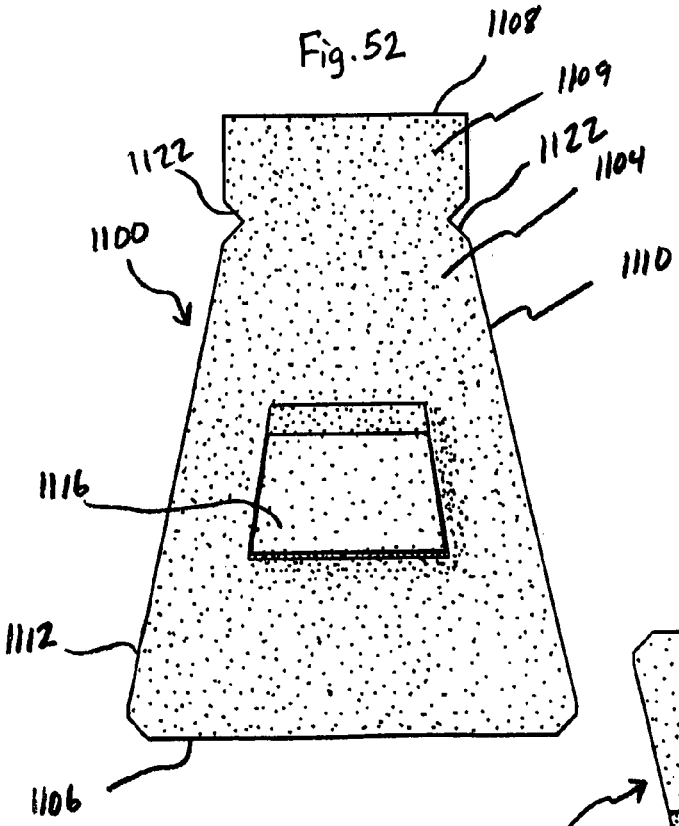
FIG. 52 is a bottom view of the modular block of FIG. 49 according to an embodiment of the present invention.
Figure 53:
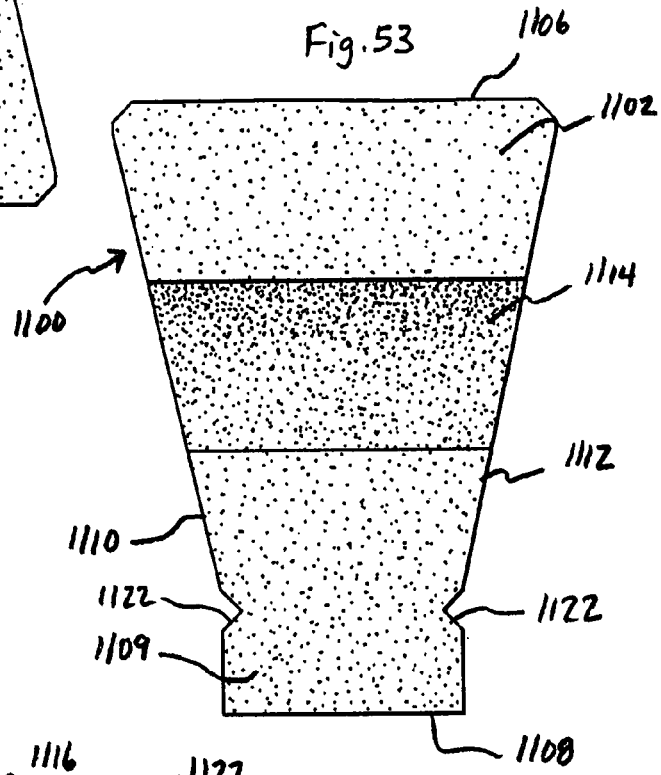
FIG. 53 is a top view of the modular block of FIG. 49 according to an embodiment of the present invention.
Figure 54:
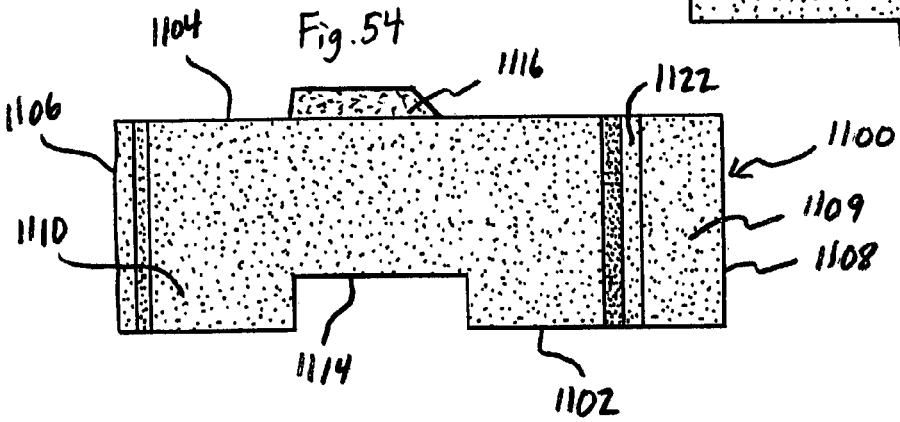
FIG. 54 is a side view of the modular block of FIG. 49 according to an embodiment of the present invention.
Figure 55:
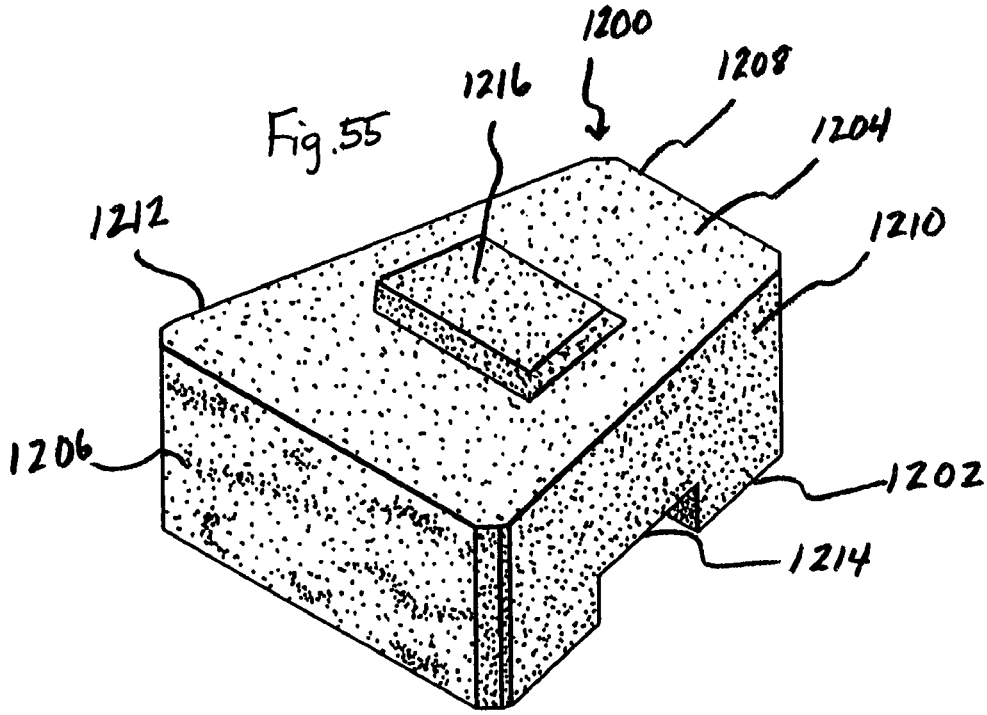
FIG. 55 is a perspective view of a modular block according to an embodiment of the present invention.
Figure 56:
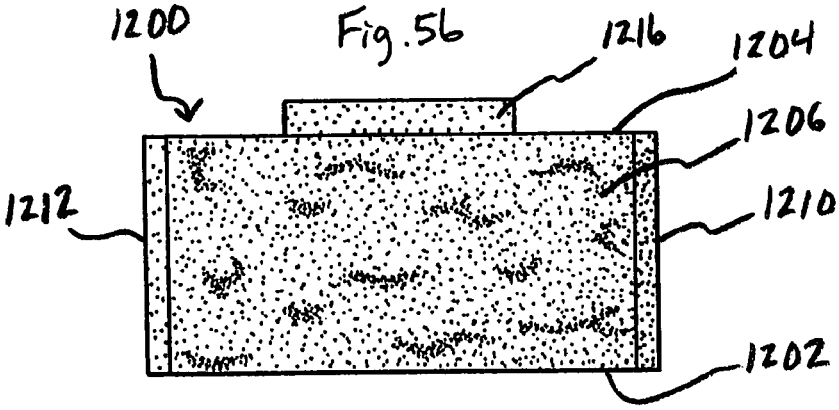
FIG. 56 is a front view of the modular block of FIG. 55 according to an embodiment of the present invention.
Figure 57:
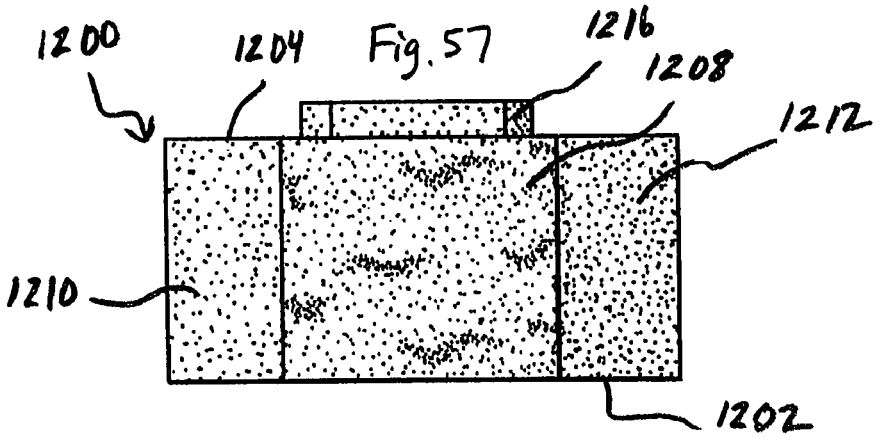
FIG. 57 is a rear view of the modular block of FIG. 55 according to an embodiment of the present invention.
Figure 58:
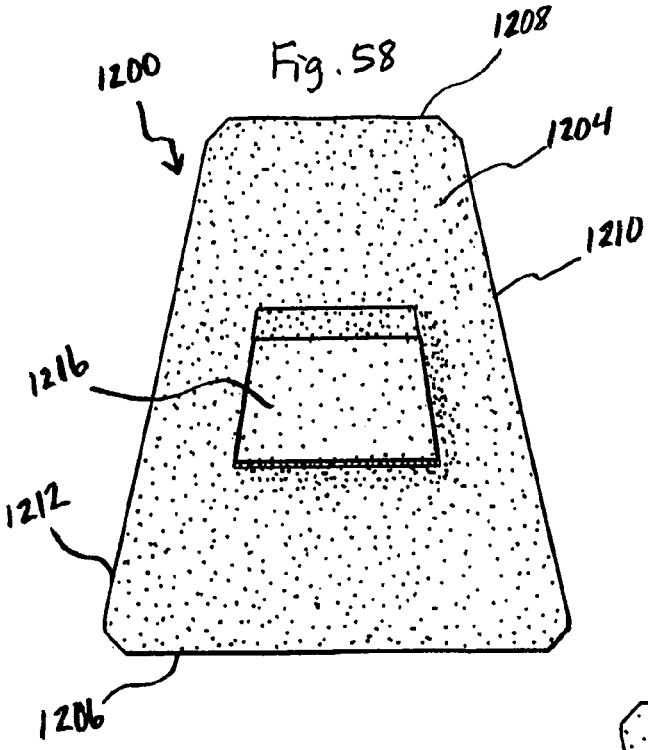
FIG. 58 is a bottom view of the modular block of FIG. 55 according to an embodiment of the present invention.
Figure 59:
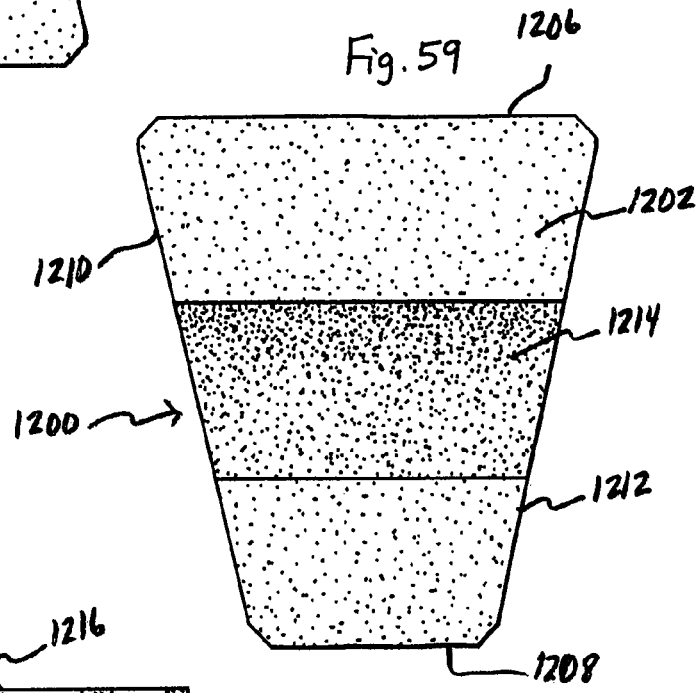
FIG. 59 is a top view of the modular block of FIG. 55 according to an embodiment of the present invention.
Figure 60:
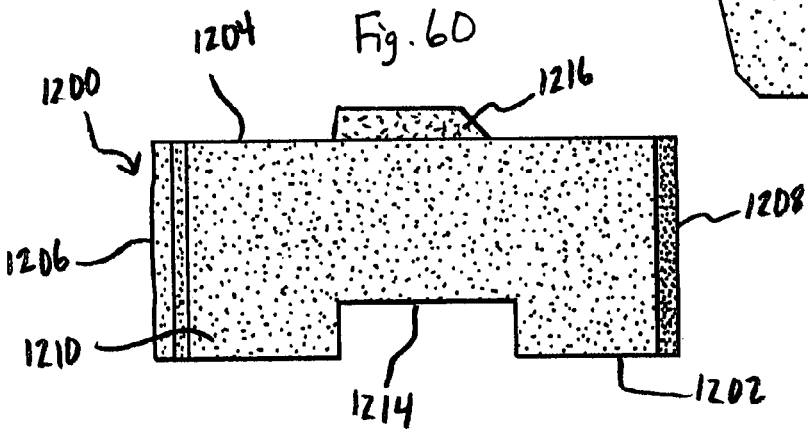
FIG. 60 is a side view of the modular block of FIG. 55 according to an embodiment of the present invention.

Referring to FIGS. 1-2 and 3A-3C, there can be seen a modular block 100 according to an example embodiment of the present invention. Modular block 100 includes a top surface 102 and opposing bottom surface 104, a front surface 106 and opposing rear surface 108 and a first side surface 110 and opposing second side surface 112. The surfaces of modular block meet to form corners 111 which may optionally be beveled, chamfered, or rounded to provide a more finished appearance. Side surfaces 110, 112 may be tapered, causing front surface 106 to be wider than rear surface 108. Modular block 100 further includes a recess 114 extending inwardly from top surface 102 and a protrusion 116 extending outwardly from bottom surface 104. Protrusion 116 can take on a variety of shapes, such as, for example, polyhedral, circular, or elliptical. As can be seen in FIGS. 3A-3C, modular block 100 may further include a sacrificial or frangible or removable portion 109 (shown in dashed lines) defined by a pair of splitter notches 122 in side surfaces 110, 112. Removable portion 109 can be cleaved off, which creates a decorative face on rear surface 108 so that modular block 100 may be used in a free standing wall.

FIGS. 4-5 and 6A-6C depict a modular block 200 according to an example embodiment of the present invention. Modular block 200 includes of a top surface 202 and opposing bottom surface 204, a front surface 206 and opposing rear surface 208, and tapered first 210 and second 212 side surfaces. Modular block 200 further includes a recess 214 extending inwardly from top surface 202 and a protrusion 216 extending outwardly from bottom surface 204. Modular block 200 may also include a sacrificial or frangible or removable portion 209 (shown in dashed lines in FIGS. 6A-6C) defined by a pair of splitter notches 222 in side surfaces 210, 212.

FIGS. 7-8 and 9A-9C depict a modular block 300 according to an example embodiment of the present invention. Modular block 300 includes a top surface 302 and opposing bottom surface 304, a front surface 306 and opposing rear surface 208, and first 310 and second 312 tapered side surfaces. Modular block 300 also includes a recess 314 extending inwardly from top surface 302 and a protrusion 316 extending outwardly from bottom surface 304. Modular block 300 further includes first 318 and second 320 cores extending through the block from top surface 302 to bottom surface 304 in order to lessen the weight of the block to aid in its transportation and assembly. Cores may be formed in various shapes, such as, for example, circular, ovate, or polygonal. Modular block 300 may also include a sacrificial or frangible or removable portion 309 (shown in dashed lines in FIGS. 9A-9C) defined by a pair of splitter notches 322 in side surfaces 310, 312.

FIGS. 10-11 and 12A-12C depict a modular block 400 according to an example embodiment of the present invention. Modular block 400 includes a top surface 402 and opposing bottom surface 404, a front surface 406 and opposing rear surface 408, and first 410 and second 412 tapered side surfaces. Modular block 400 also includes a recess 414 extending inwardly from top surface 402 and a protrusion 416 extending outwardly from bottom surface 404. Modular block 400 further includes first 418 and second 420 cores through the block from top surface 402 to bottom surface 404. Modular block 400 may also include a removable portion 409 (shown in dashed lines in FIGS. 12A-12C) defined by a pair of splitter notches 422 in side surfaces 410, 412.

Referring to FIGS. 13-18, there can be seen another modular block 500 according to an example embodiment of the present invention. Modular block 500 includes a top surface 502 and opposing bottom surface 504, a front surface 506 and opposing rear surface 508 and a first side surface 510 and opposing second side surface 512. The surfaces of modular block meet to form corners 511 which may optionally be beveled, chamfered, or rounded to provide a more finished appearance. Side surfaces 510, 512 may be tapered, causing front surface 506 to be wider than rear surface 508. Modular block 500 further includes a recess 514 extending inwardly from top surface 502 and a protrusion 516 extending outwardly from bottom surface 504. Protrusion 516 can take on a variety of shapes, such as, for example, polyhedral, circular, or elliptical. Modular block 500 further includes first 518 and second 520 cores through the block from top surface 502 to bottom surface 504. Cores may be formed in various shapes, such as, for example, circular, ovate, or polygonal. Modular block 500 may further include a sacrificial or frangible or removable portion 509, defined by a pair of splitter notches 522 in side surfaces 510, 512. Removable portion 509 can be cleaved off, which creates a new rear surface having a decorative face. As will be explained more fully below with reference to FIGS. 63A and 63B, it is desirable to cleave off removable portion 509 thereby creating a decorative rear face when modular blocks 500 are used to build a freestanding wall having two visible sides.

FIGS. 19-24 depict a further modular block 600 according to an example embodiment of the present invention. Modular block 600 includes a top surface 602 and opposing bottom surface 604, a front surface 606 and opposing rear surface 608, and first 610 and second 612 tapered side surfaces. Modular block 600 also includes a recess 614 extending inwardly from top surface 602 and a protrusion 616 extending outwardly from bottom surface 604. Modular block 600 further includes first 618 and second 620 cores through the block from top surface 602 to bottom surface 604.

FIGS. 25-30 depict another modular block 700 according to an example embodiment of the present invention. Modular block 700 includes a top surface 702 and opposing bottom surface 704, a front surface 706 and opposing rear surface 708, and first 710 and second 712 tapered side surfaces. Modular block 700 also includes a recess 714 extending inwardly from top surface 702 and a protrusion 716 extending outwardly from bottom surface 704. Modular block 700 further includes first 718 and second 720 cores through the block from top surface 702 to bottom surface 704. Modular block 700 may also include a sacrificial or frangible or removable portion 709, defined by a pair of splitter notches 722 in side surfaces 710, 712.

FIGS. 31-36 depict a further modular block 800 according to an embodiment of the present invention. Modular block 800 includes a top surface 802 and opposing bottom surface 804, a front surface 806 and opposing rear surface 808, and first 810 and second 812 tapered side surfaces. Modular block 800 also includes a recess 814 extending inwardly from top surface 802 and a protrusion 816 extending outwardly from bottom surface 804. Modular block 800 further includes first 818 and second 820 cores through the block from top surface 802 to bottom surface 804. Modular block 800 may be formed in the mold in which it is made with rear surface 808, or rear surface 808 may be formed by cleaving off a removable portion, such as the removable portion 709 of modular block 700.

Referring to FIGS. 37-42, there is depicted a modular block 900 according to an example embodiment of the present invention. Modular block 900 include a top surface 902 and opposing bottom surface 904, a front surface 906 and opposing rear surface 908, and tapered first 910 and second 912 side surfaces. Modular block 900 further includes a recess 914 extending inwardly from top surface 902 and a protrusion 916 extending outwardly from bottom surface 904. Modular block 900 may also include a sacrificial or frangible or removable portion 909, defined by a pair of splitter notches 922 in side surfaces 910, 912.

FIGS. 43-48 depict a further modular block 1000 according to an example embodiment of the present invention. Modular block 1000 includes a top surface 1002 and opposing bottom surface 1004, a front surface 1006 and opposing rear surface 1008, and first 1010 and second 1012 tapered side surfaces. Modular block 1000 also includes a recess 1014 extending inwardly from top surface 1002 and a protrusion 1016 extending outwardly from bottom surface 1004.

FIGS. 49-54 depict another modular block 1100 according to an example embodiment of the present invention. Modular block 1100 includes a top surface 1102 and opposing bottom surface 1104, a front surface 1106 and opposing rear surface 1108, and first 1110 and second 1112 tapered side surfaces. Modular block 1100 also includes a recess 1114 extending inwardly from top surface 1102 and a protrusion 1116 extending outwardly from bottom surface 1104. Modular block

1100 may also include a sacrificial or frangible or removable portion 1109, defined by a pair of splitter notches 1122 in side surfaces 1110, 1112.

FIGS. 55-60 depict a further modular block 1200 according to an example embodiment of the present invention. Modular block 1200 includes a top surface 1202 and opposing bottom surface 1204, a front surface 1206 and opposing rear surface 1208, and first 1210 and second 1212 tapered side surfaces. Modular block 1200 also includes a recess 1214 extending inwardly from top surface 1202 and a protrusion 1216 extending outwardly from bottom surface 1204.

The outer surfaces of the blocks may be given a decorative appearance such as broken rock, stacked rocks, natural stone, brick, striated or roughened texture. Persons of skill in the art of concrete block manufacture using the dry-cast process will recognize that various decorative appearances can be imparted on one or more of the surfaces of the blocks, and that the present invention is not limited to a specific decorative facial appearance unless specifically indicated in a given Claim. If desired, decorative faces can be provided to both the front surfaces and opposing rear surfaces of the blocks. The solid side surfaces of the blocks (as opposed to blocks having insets in their side surfaces) provide the block with sufficient structural integrity that decorative faces may be formed by tumbling. One of skill in the art will recognize that decorative faces may be imparted to the blocks by various other methods, such as, for example, splitting or striation. Alternatively, one or more outer surfaces may be provided with a smooth appearance.

Figure 61:
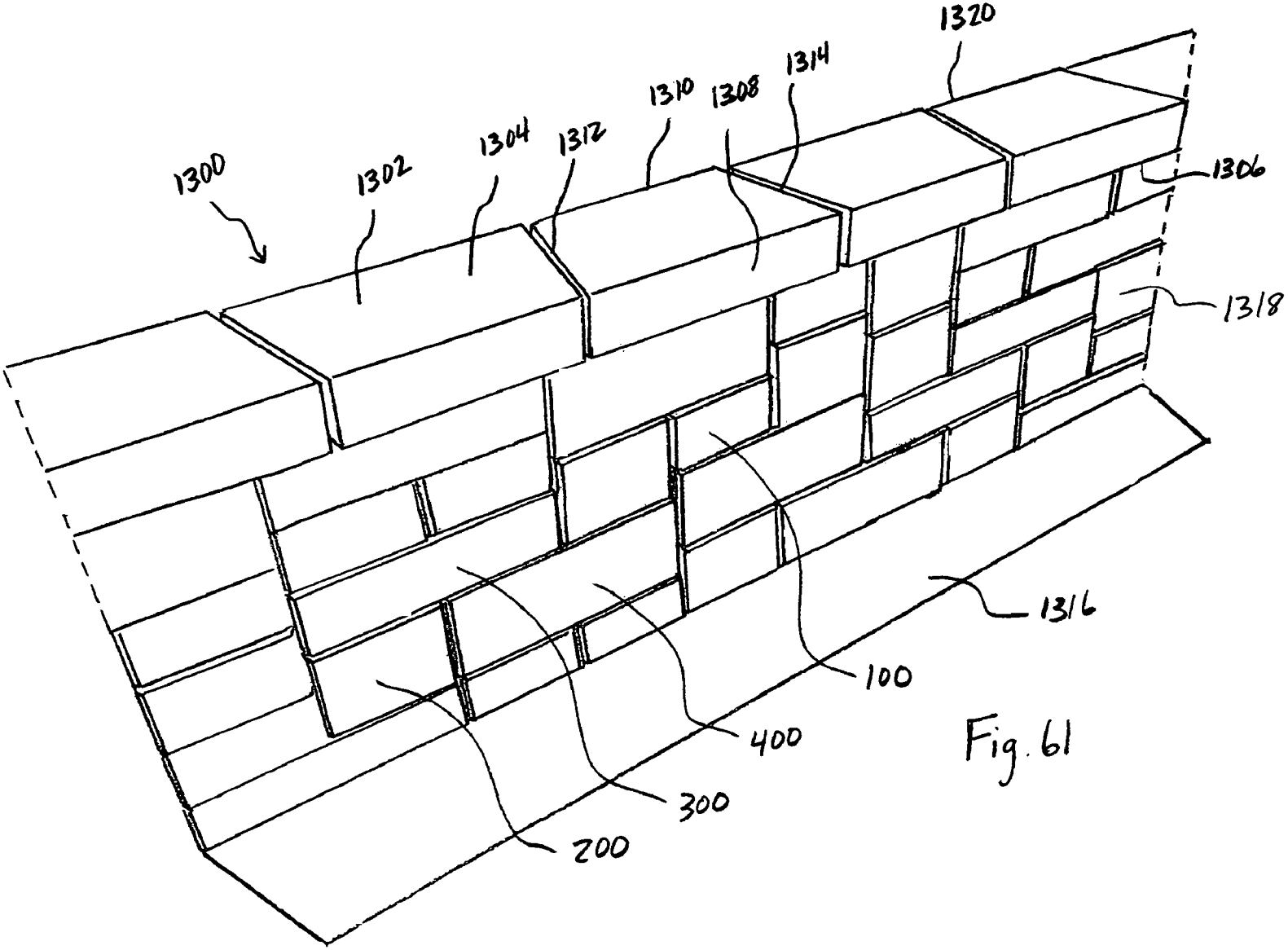
FIG. 61 is a perspective view of a portion of a modular block wall according to an embodiment of the present invention.
Figure 62:
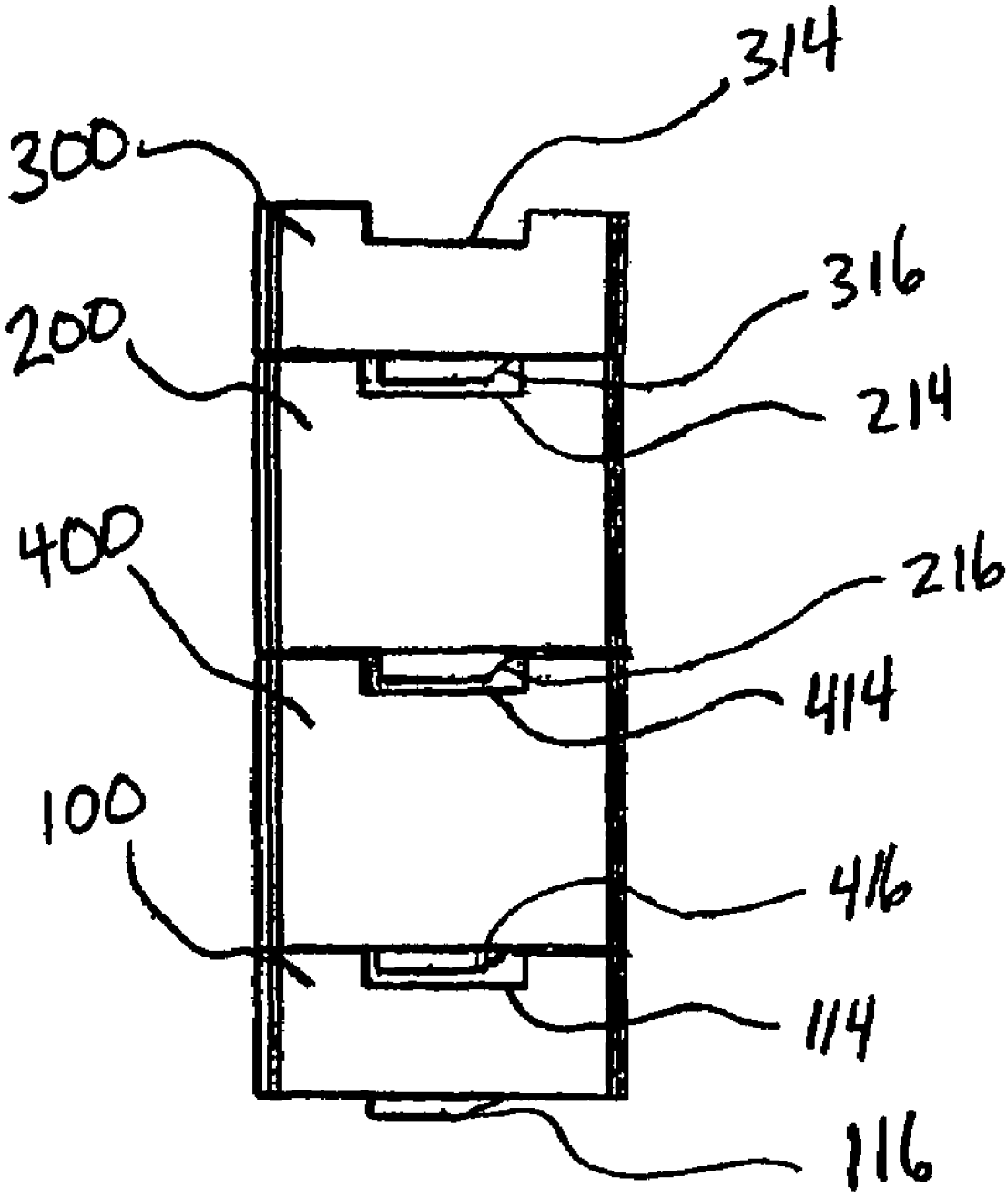
FIG. 62 is a side view of a column of modular blocks according to an embodiment of the present invention.

Referring now to FIG. 61, there can be seen a section of a modular block wall 1300 according to an embodiment of the present invention. Modular block wall 1300 includes a plurality of differently sized modular blocks, for example, modular blocks 100, 200, 300, 400, and may include cap blocks 1302. Modular blocks can be stacked in courses starting at ground level 1316 to any desired height. Any combination of blocks may be used to create a non-uniform wall. Blocks can be stacked in a combination of columnar fashion and running bond fashion relative to each other. The protrusion of any of the disclosed modular blocks can be configured to fit into the recess of any other disclosed modular block, regardless of similarities in height and width between blocks. Modular blocks of different sizes can be stacked together in any configuration, as shown with respect to modular blocks 100, 200, 300, and 400 in FIG. 62, due to the ability of the protrusion 116, 216, 316, 416 of each of the block variations to fit into the recess 114, 214, 314, 414 of any other block variation. The diverging side surfaces of modular blocks allow serpentine retaining walls and freestanding walls to be constructed because the smaller rear surfaces will not interfere with one another when adjacent blocks are angled with respect to each other.

Modular blocks can be used to form either retaining walls or free-standing walls. To form a free-standing wall, adjacent blocks are aligned as in FIG. 63A, with a horizontal 180 degree rotation between adjacent blocks 1400*a*, 1400*b*. Thus front surface 1406*a* of a first block 1400*a* and rear surface 1408*b* of an adjacent second block 1400*b* face one direction and rear surface 1408*a* of the first block 1400*a* and front surface 1406*b* of the second block 1400*b* face the opposite direction. The tapered side surfaces 1412*a*, 1410*b* of the blocks align with one another and allow the outwardly facing surfaces 1406*a*, 1406*b*, 1408*a*, 1408*b* to abut directly against one another. This creates a more aesthetically pleasing appearance because no large gaps are visible between the blocks when viewed from either side of the wall. Because the blocks 1400*a*, 1400*b* may be given decorative faces on their front and rear surfaces, a two-sided decorative wall is created. Decorative rear surfaces can be formed by splitting the removable portion off of a modular block, such as modular blocks 500, 700, 900, and 1100. Alternatively, rear surfaces may be provided with a decorative face by any of the other methods described above or otherwise known to one of ordinary skill in the art.

Figure 63B:
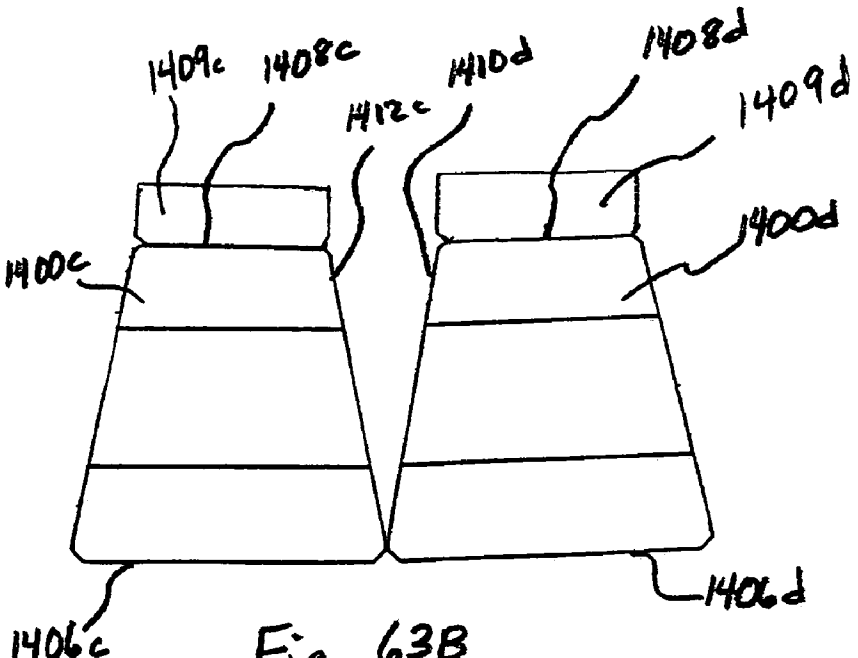
FIG. 63A and FIG. 63B are top views of two adjacent modular blocks according to embodiments of the present invention.

To form a retaining wall, adjacent blocks may also be aligned as described above and shown in FIG. 63A. However, because a retaining wall has only one visible side, adjacent blocks may also be aligned as in FIG. 63B. In FIG. 63B, there is no horizontal rotation between adjacent blocks 1400*c*, 1400*d*. Blocks 1400*c*, 1400*d* are aligned such that the decorative front surfaces 1406*c*, 1406*d* of both blocks face outward. A relatively large gap is created by smaller rear surfaces 1408*c*, 1408*d* because adjacent tapered side surfaces 1410*d*, 1412*c* diverge away from each other. This does not affect the appearance of the wall, however, as rear surfaces 1408*c*, 1408*d* of blocks in a retaining wall are not visible. Thus, removable portions 1409*c*, 1409*d* can be left on the blocks. Rear surfaces therefore need not be provided with a decorative appearance.

Cap blocks 1302 may be used at the top of the block wall system 1300 to cover the cavities and recesses in the blocks and provide a more finished appearance. Cap blocks 1302 may be natural stones or may be manufactured. Cap blocks 1302 includes a top surface 1304 and opposing bottom surface 1306, a front surface 1308 and opposing rear surface 1310 and opposing first 1312 and second 1314 side surfaces. Both front 1308 and rear 1310 surfaces may be provided with a decorative face depending on the type of wall that cap blocks 1302 are being used with. Side surfaces 1312, 1314 may be tapered. Bottom surface 1306 may be flat, and simply rest flush with top surface of the uppermost course of modular blocks. Alternatively, cap blocks 1302 may be provided with a protrusion on bottom surface 1306 similar to the protrusion provided to modular blocks so that it can interlock with the uppermost course of modular blocks.

Figure 63A:
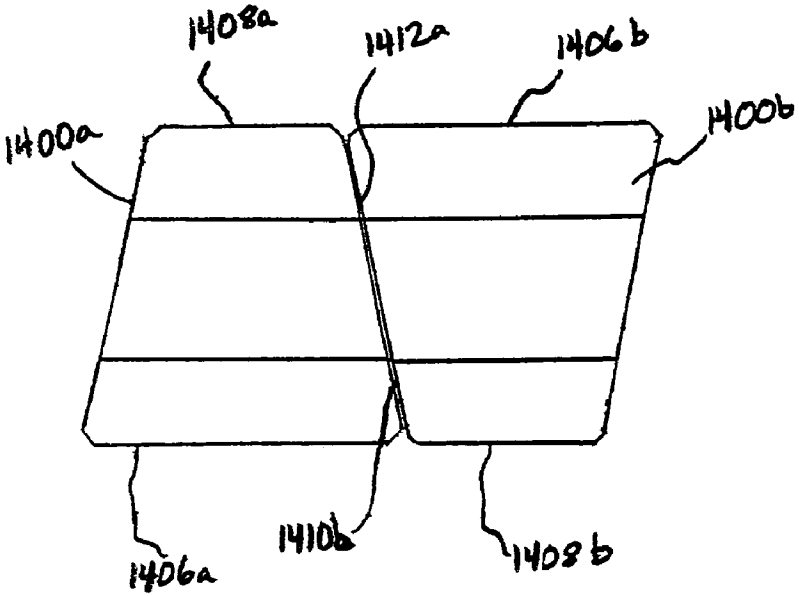
Figure 64C:
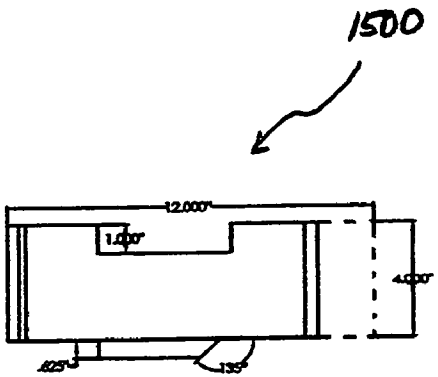
FIG. 64C is a side view of a modular block according to an embodiment of the present invention.
Figure 64B:
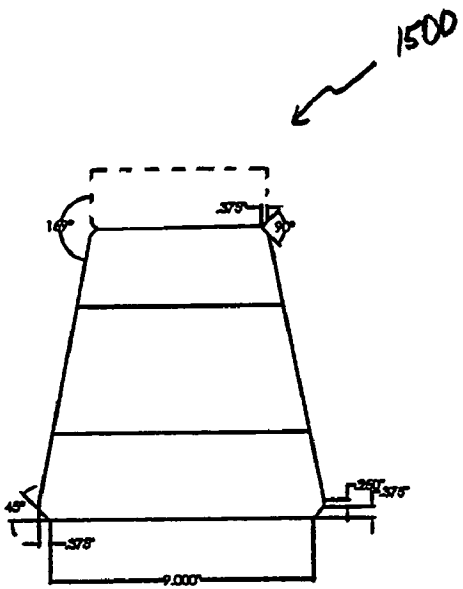
FIG. 64B is a top view.
Figure 64A:
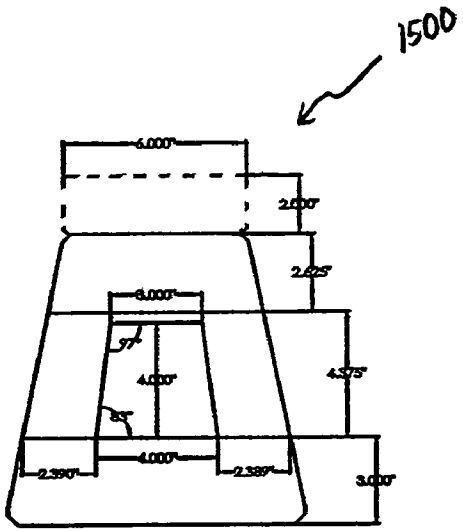
FIG. 64A is a bottom view.
Figure 65C:
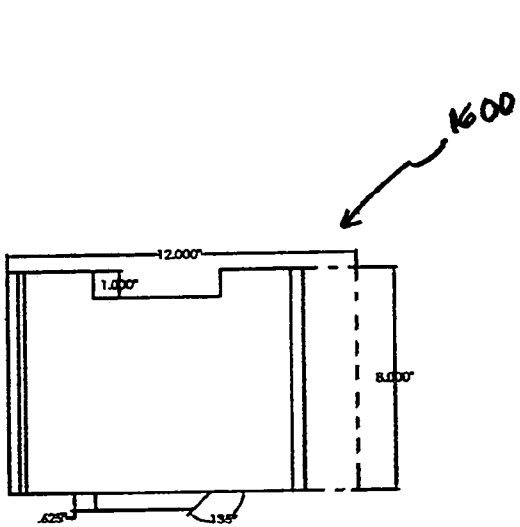
FIG. 65C is a side view of a modular block according to an embodiment of the present invention.
Figure 65B:
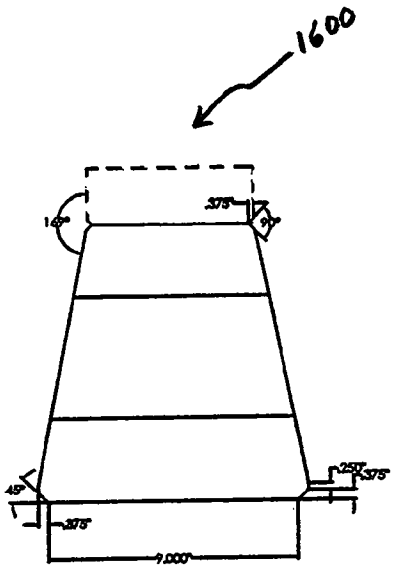
FIG. 65B is a top view.
Figure 65A:
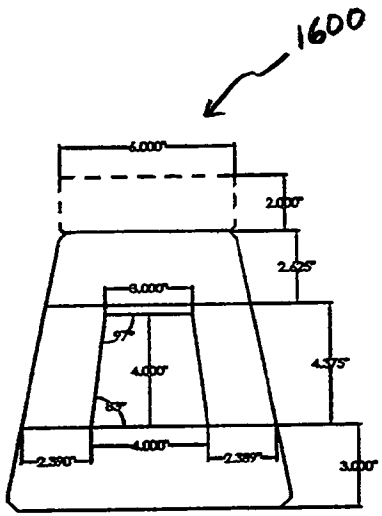
FIG. 65A is a bottom view.
Figure 66C:
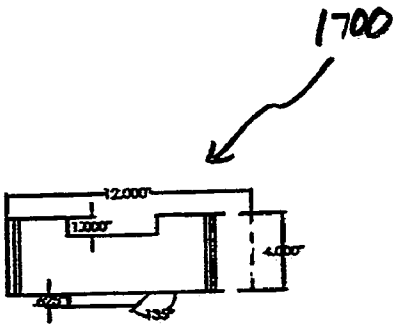
FIG. 66C is a side view of a modular block according to an embodiment of the present invention.
Figure 66B:
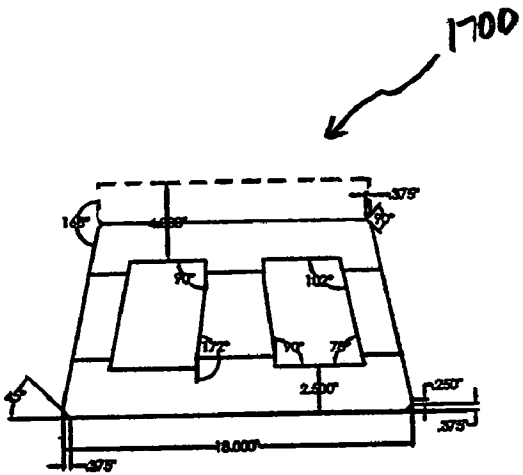
FIG. 66B is a top view.
Figure 66A:
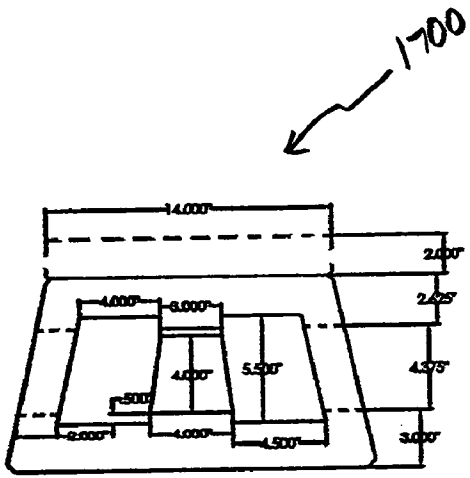
FIG. 66A is a bottom view.
Figures 67A, 67B, 67C:
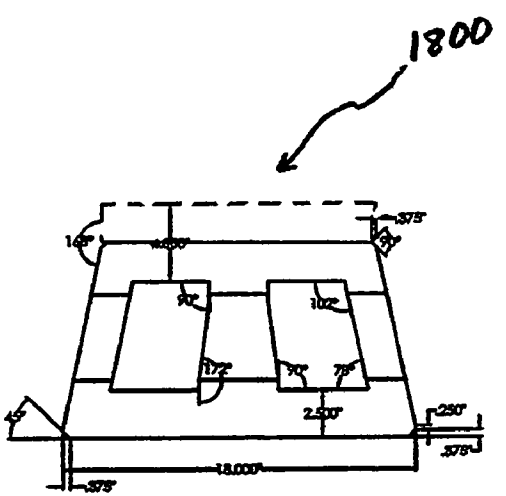
FIG. 67A is a bottom view.
FIG. 67B is a top view.
FIG. 67C is a side view of a modular block according to an embodiment of the present invention.

In a free-standing wall, cap blocks 1302 will be laid with opposing tapered side surfaces 1312, 1314 aligned, as in FIGS. 61 and 63A, creating a wall where both the front side 1318 and rear side 1320 present a finished decorative appearance void of any significant gaps between outer block surfaces. In a retaining wall, cap blocks can align in either of the ways depicted in FIG. 63A or 63B.

The modular blocks of the present invention are preferably made from a rugged, weather resistant material, such as concrete, for high strength and durability in outdoor applications. Modular blocks are most preferably manufactured at high speeds using the so called dry-cast manufacturing method known in the art. In such a process, modular blocks can be manufactured with the protrusion facing upwards. One or more core pullers can be used to form the recesses in the blocks and core forms can be used to form any cores. The low or zero slump concrete material composition for such process generally includes sand, cement, aggregate and selected admixtures. Persons having skill in the art of dry-cast concrete block manufacture understand that material mixtures can be varied to meet a variety of performance requirements. Alternatively, modular blocks may be made of numerous other materials, for example, plastic, fiberglass, wood, metal, or stone.

Modular blocks can be manufactured to any desired dimensions and any number of differently sized blocks may be used in any one wall system. FIGS. 64A-64C, 65A-65C, 66A-66C, and 67A-67C depict one preferred embodiment of the present invention which uses four differently, but complementary, sized blocks. Complementary sized blocks preferably have a uniform height and a uniform width dimension such that the height and width of each block is equal to or a whole fraction of, such as one-half, one-third, one-fourth, etc., the uniform dimensions. For example, the four blocks depicted 1500, 1600, 1700, 1800 are variations of two different front surface widths and two different thicknesses. The first block 1500 is 9 inches wide by 4 inches in height, the second block 1600 is 9 inches wide by 8 inches in height, the third block 1700 is 18 inches wide by 4 inches in height and the fourth block 1800 is 18 inches wide by 8 inches in height. Thus, there is a uniform 18 inch width dimension and an 8 inch uniform height dimension. Similarly, the rear surfaces of the blocks are two different widths—the first 1500 and second 1600 blocks are 6 inches wide and the third 1700 and fourth 1800 blocks are 14 inches wide. The distance between the front surface and rear surface of each of the four blocks is 10 inches. These complementary sizes allow modular blocks to be easily put together in any configuration to create a finished looking, yet non-uniform wall such as the wall 1300 depicted in FIG. 61. One of skill in the art will recognize that these dimensions can be varied.

Figure 68:
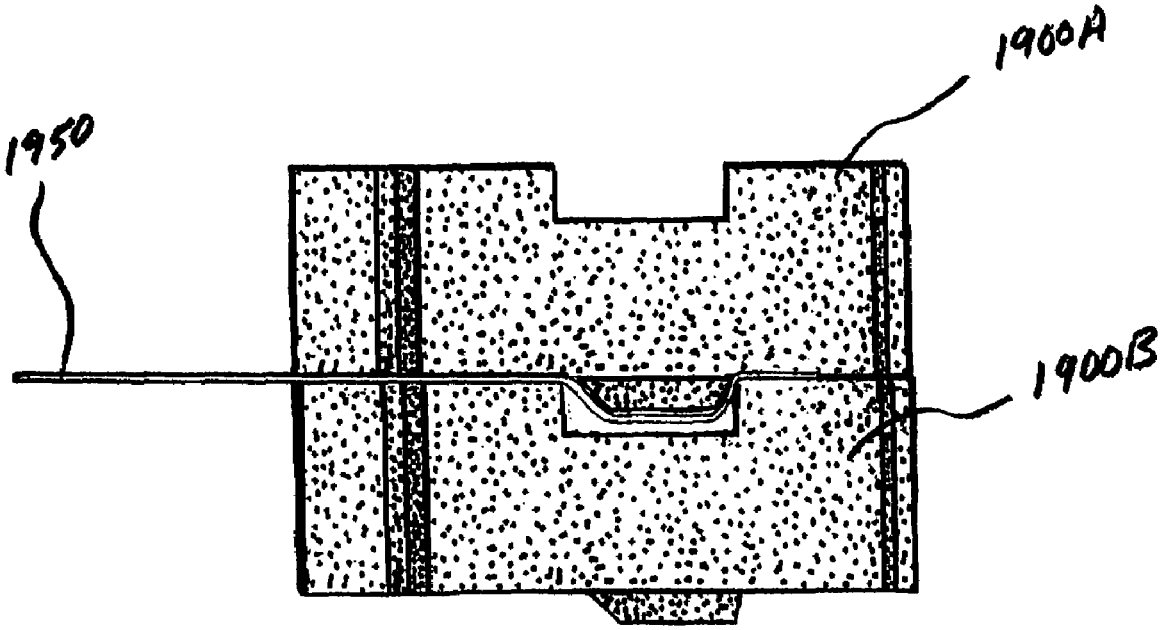
FIG. 68 is a side view of a pair of modular blocks according to an embodiment of the present invention in combination with a flexible plastic earth anchor.
Figure 69:
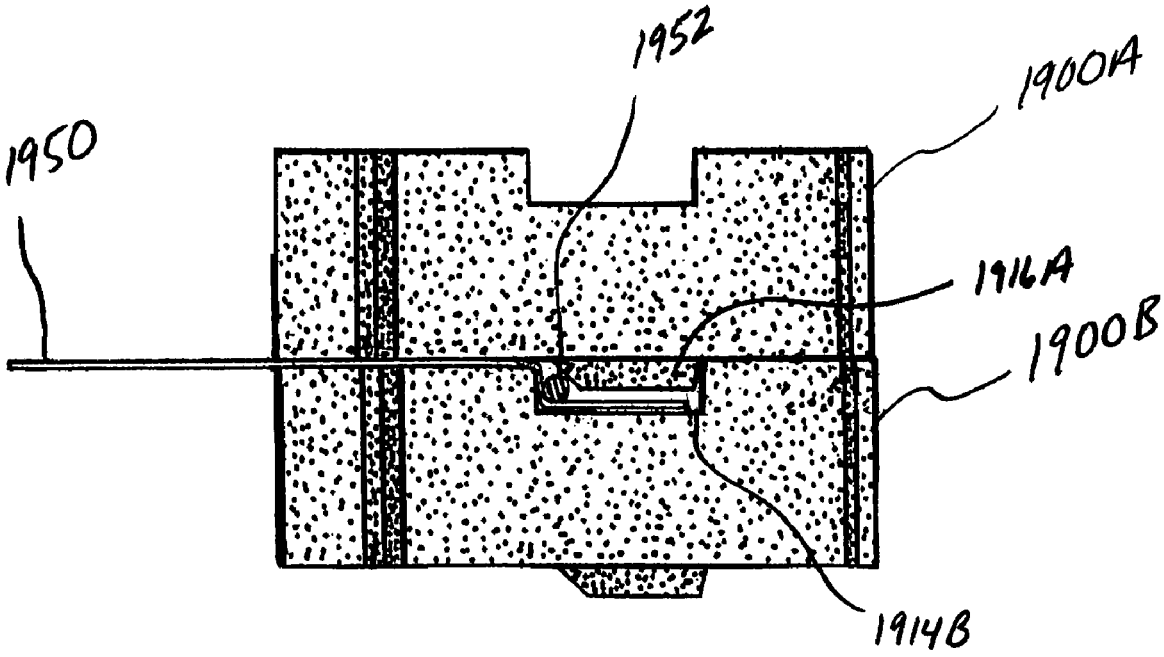
FIG. 69 is a side view of a pair of modular blocks according to an embodiment of the present invention in combination with a flexible plastic earth anchor and an elongated fixation bar.
Figure 70:
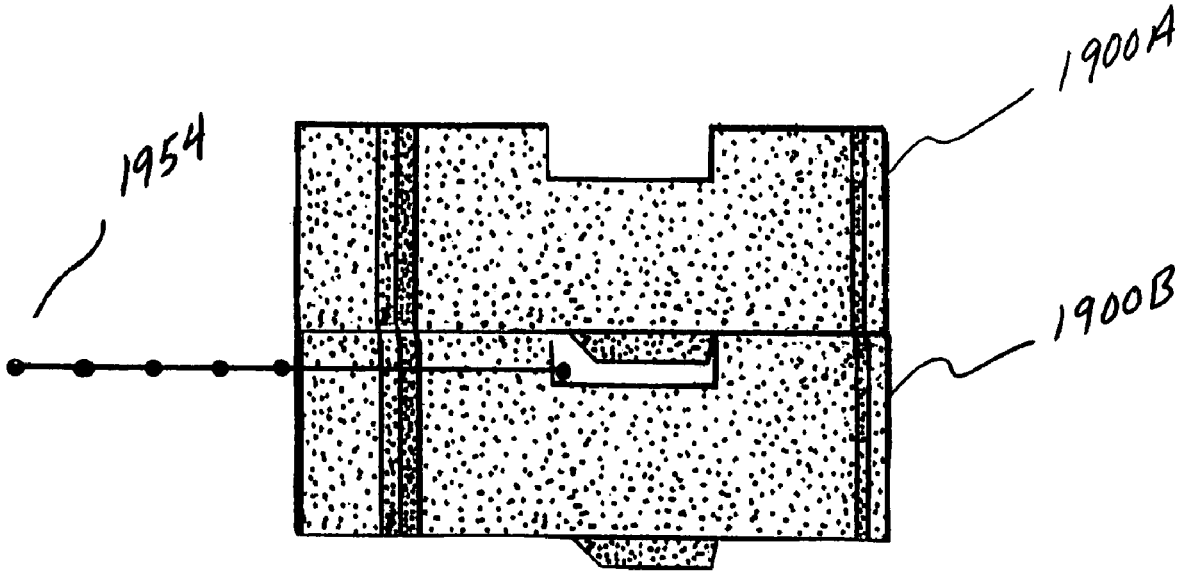
FIG. 70 is a side view of a pair of modular blocks according to an embodiment of the present invention in combination with a metallic lattice earth anchor.

Modular blocks according to embodiments of the present invention can also be used in conjunction with earth anchors or soil reinforcement. The use of earth anchors to stabilize blocks in a retaining wall is disclosed in copending U.S. Publ. No. 2006/0096180A1, which is hereby incorporated by reference in its entirety. As can be seen in FIG. 68, a deformable, flexible plastic earth anchor 1950, such as, for example, geogrid, can be positioned between a pair of modular blocks 1900A, 1900B and extended back into soil backfilled behind a retaining wall. The weight and shape of the modular blocks 1900A, 1900B holds the flexible plastic earth anchor 1950 in place. In one alternative, as shown in FIG. 69, a flexible plastic earth anchor 1950 can be partially wrapped or otherwise connected to an elongated fixation bar 1952, such as a piece of rebar, to restrainingly engage flexible plastic earth anchor 1950. Elongated fixation bar 1952 can rest within the slot 1914B of a modular block 1900B in an area not occupied by the projection 1916A of a vertically adjacent modular block 1900A. As can be seen in FIG. 70, modular blocks 1900A, 1900B can also be used with a rigid, metallic lattice earth anchor 1950.

Figure 71:
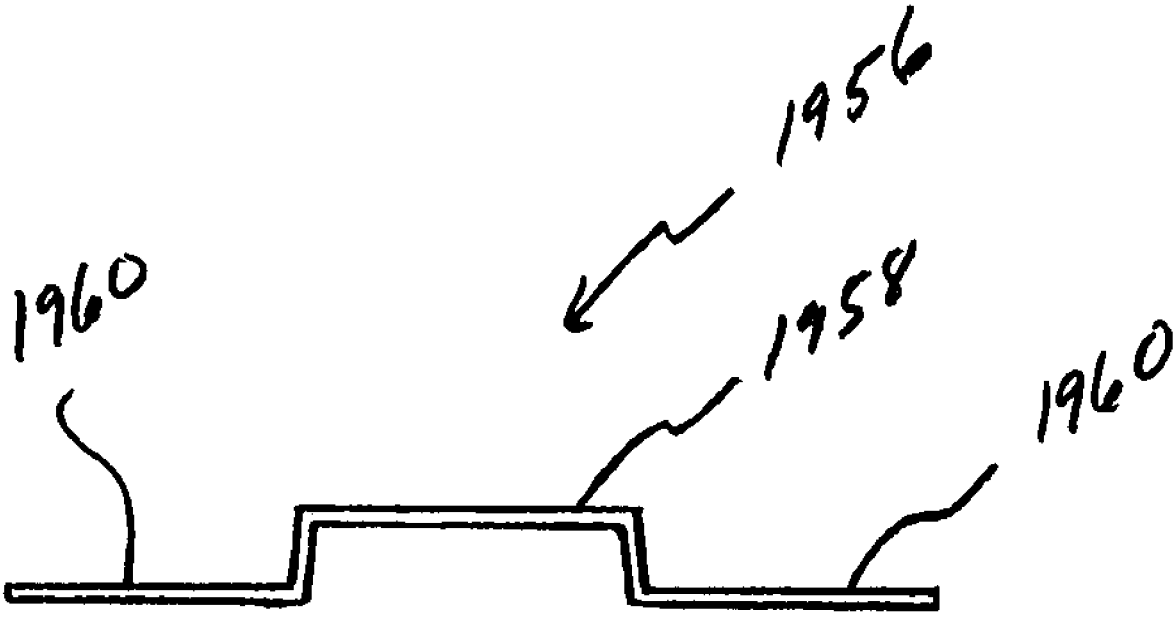
FIG. 71 is a front view of an earth anchor securing member that can be used with modular blocks according to an embodiment of the present invention.
Figure 72:
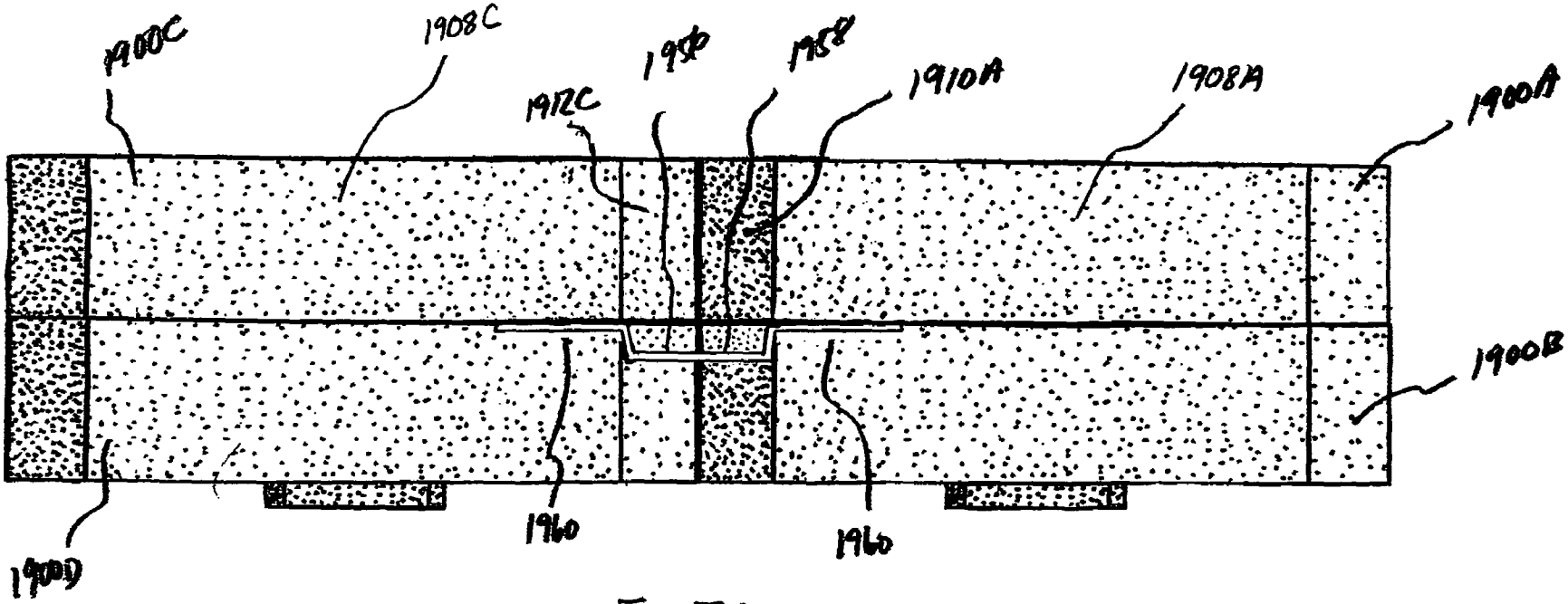
FIG. 72 is a rear view of a plurality of modular blocks and an earth anchor securing member according to an embodiment of the present invention.
Figure 73:
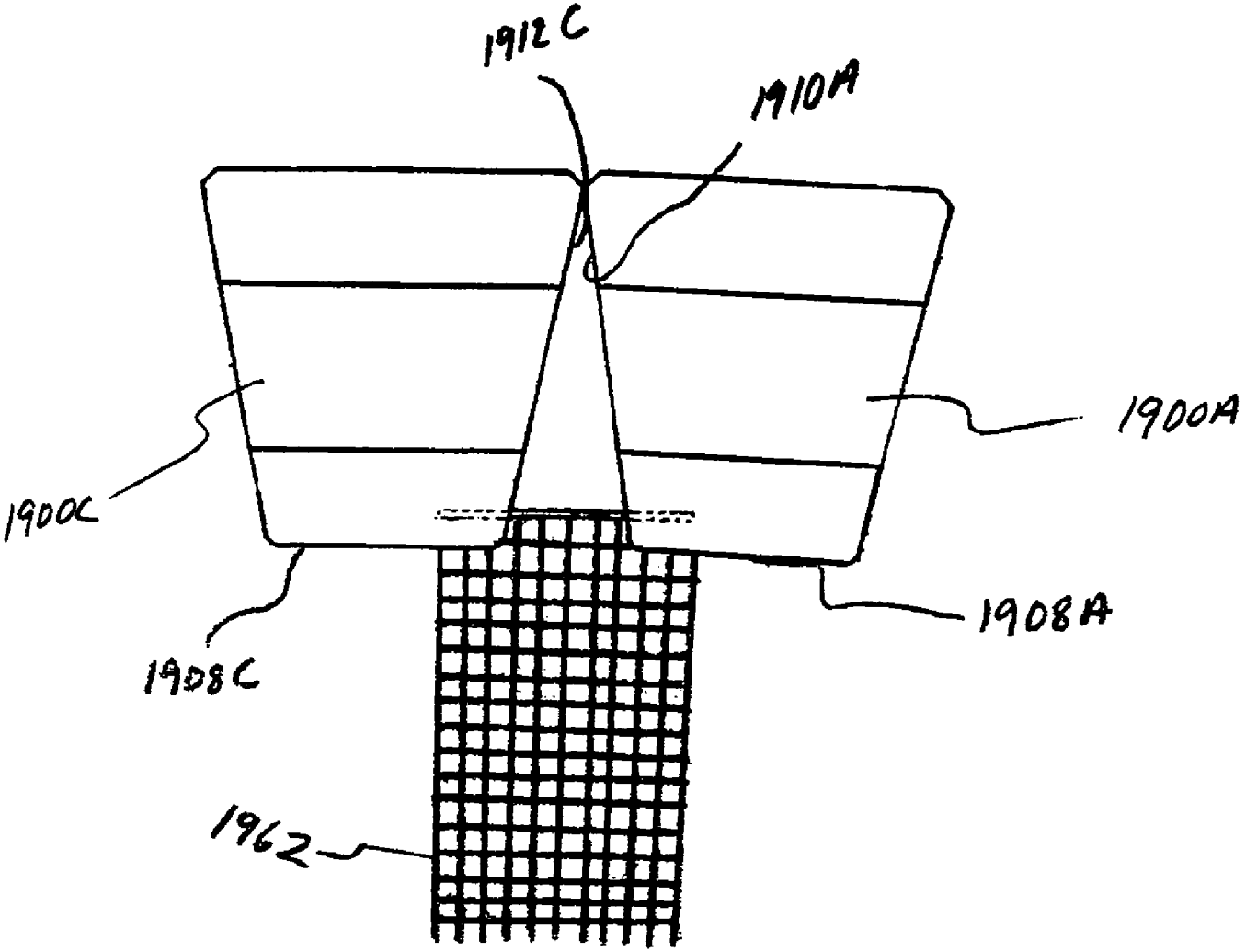
FIG. 73 is a top view of a pair of modular blocks and an earth anchor securing member according to an embodiment of the present invention.

Referring now to FIGS. 71-73, modular blocks and earth anchors can also be used in conjunction with a rigid earth anchor securing member 1956. Earth anchor securing member 1956 may include a spacer portion 1958 and a pair of wings 1960. Earth anchor securing member 1956 can serve dual functions of maintaining proper spacing between adjacent modular blocks and providing an attachment point for an earth anchor. Each wing 1960 of earth anchor securing member 1956 can be held between an upper 1900A, 1900C and lower 1900B, 1900D pair of modular blocks to fix earth anchor securing member 1956 in place. An earth anchor 1962 can be connected to earth anchor securing member 1956 and extended into the backfilled soil by looping it over wings 1960 and/or spacer portion 1958 of earth anchor securing member 1956. Spacer portion 1958 abuts against adjacent side surfaces 1910A, 1912C of adjacent modular blocks 1900A, 1900C to ensure that proper spacing between the blocks is maintained. If greater or lesser spacing between blocks is desired, earth anchor securing member 1956 can be moved nearer or farther from the rear surfaces 1908A, 1908C of the spaced blocks 1900A, 1900C. Alternatively, earth anchor securing member 1956 can be used to fill in the recesses going across adjacent blocks and then connected to an earth anchor 1962. Spacer portion 1958 of earth anchor securing member 1956 can take on a variety of shapes, such as, for example, arcuate, triangular, or rectangular.

Although the present invention has been described with reference to preferred embodiments, workers skilled in the art will recognize that changes may be made in form and detail without departing from the spirit and scope of the invention.

The invention claimed is:

1. A concrete block that can be used to construct a retaining wall or a free-standing wall, the block comprising:

a front surface and opposing rear surface, a top surface and opposing bottom surface, and opposing first and second side surfaces, wherein the first and second side surfaces taper inwardly from the front surface to the rear surface, such that the front surface is wider than the rear surface;

a projection extending outwardly from the block top surface or bottom surface;

a recess on the opposite block top surface or bottom surface from where the projection is located, the recess extending transversely across the block between the opposing first and second side surfaces, wherein the projection is arranged and configured to be received in the recess of a block in an adjacent course of blocks; and a plurality of cores extending through the block from the top surface to the bottom surface, wherein the projection has opposing first and second side surfaces, and wherein an inner surface of the first core is coplanar with the first side surface of the projection and an inner surface of the second core is coplanar with the second side surface of the projection.

2. The block of claim 1, wherein the projection is polyhedral.

3. The block of claim 1, wherein the front surface is provided with a decorative appearance.

4. The block of claim 1, wherein the rear surface is provided with a decorative appearance.

5. The block of claim 1, wherein both the front surface and the rear surface are provided with a decorative appearance.

6. The block of claim 1, further including a removable portion.

7. The block of claim 6, wherein the removable portion is defined by the rear surface and a pair of splitter grooves and wherein one splitter groove is located in each of the opposing first and second side surfaces.

8. The block of claim 1, wherein the block includes a first core and a second core.

9. The block of claim 1, wherein the projection is arranged and configured to be received in the recess of a block in an adjacent course of blocks whether the block is in the same orientation as the block in the adjacent course of blocks or is rotated horizontally 180 degrees with respect to the block in the adjacent course of blocks.

10. The block of claim 1, wherein the block has a width dimension, defined by the width of the front surface extending between first side surface and second side surface, and a height dimension, defined by the height of front surface extending between top surface and bottom surface, and wherein the projection is arranged and configured to be received in the recess of a block in an adjacent course of blocks even if the block in the adjacent course of blocks has a different height dimension and/or a different width dimension than the block.

11. A concrete block that can be used to construct a retaining wall or a free-standing wall, the block comprising:

a front surface and opposing rear surface, a top surface and opposing bottom surface, and opposing first and second side surfaces extending between front surface and rear surface, wherein a width dimension of front surface extending from first side surface to second side surface is greater than a width dimension of rear surface extending from first side surface to second side surface;

a projection extending outwardly from the block top surface or bottom surface; and a recess on the opposite block top surface or bottom surface from where the projection is located, the recess extending transversely across the block between the opposing first and second side surfaces, wherein the projection is arranged and configured to be received in the recess of a block in an adjacent course of blocks, wherein the projection has opposing first and second side surfaces, and wherein an inner surface of the first core is coplanar with the first side surface of the projection and an inner surface of the second core is coplanar with the second side surface of the projection.

12. The block of claim 11, wherein the projection is polyhedral.

13. The block of claim 11, wherein the front surface is provided with a decorative appearance.

14. The block of claim 11, wherein the rear surface is provided with a decorative appearance.

15. The block of claim 11, wherein both the front surface and the rear surface are provided with a decorative appearance.

16. The block of claim 11, further including a removable portion.

17. The block of claim 16, wherein the removable portion is defined by the rear surface and a pair of splitter grooves, one splitter groove located in each of the opposing first and second side surfaces.

18. The block of claim 11, wherein the projection is arranged and configured to be received in the recess of a block in an adjacent course of blocks whether the block is in the same orientation as the block in the adjacent course of blocks or is rotated horizontally 180 degrees with respect to the block in the adjacent course of blocks.

19. The block of claim 11, wherein the block has a width dimension, defined by the width of the front surface extending between first side surface and second side surface, and a height dimension, defined by the height of front surface extending between top surface and bottom surface, and wherein the projection is arranged and configured to be received in the recess of a block in an adjacent course of blocks even if the block in the adjacent course of blocks has a different height dimension and/or a different width dimension than the block.

* * * * *